US008501380B2

(12) United States Patent
Ishihara et al.

(10) Patent No.: US 8,501,380 B2
(45) Date of Patent: Aug. 6, 2013

(54) ELECTROSTATIC LATENT IMAGE DEVELOPING TONER, ELECTROSTATIC LATENT IMAGE DEVELOPER, TONER CARTRIDGE, PROCESS CARTRIDGE AND IMAGE FORMING APPARATUS

(75) Inventors: Yuka Ishihara, Kanagawa (JP); Masaki Nakamura, Kanagawa (JP); Satoshi Inoue, Kanagawa (JP); Katsumi Daimon, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 332 days.

(21) Appl. No.: 12/857,998

(22) Filed: Aug. 17, 2010

(65) Prior Publication Data

US 2011/0236812 A1 Sep. 29, 2011

(30) Foreign Application Priority Data

Mar. 25, 2010 (JP) ..... 2010-069812

(51) Int. Cl.
*G03G 9/087* (2006.01)
*G03G 9/10* (2006.01)

(52) U.S. Cl.
USPC ..... 430/109.4; 430/108.3; 430/111.35

(58) Field of Classification Search
USPC ..... 430/109.4, 111.35, 108.3
See application file for complete search history.

(56) References Cited

U.S. PATENT DOCUMENTS 5,429,898 A 7/1995 Sugizaki et al.
5,753,399 A 5/1998 Hayase et al.
6,040,102 A * 3/2000 Takahashi et al. ..... 430/108.6
2004/0142264 A1 7/2004 Tanaka et al.
2008/0166651 A1 7/2008 Vanbesien et al.
2010/0209835 A1 * 8/2010 Takahashi et al. ..... 430/105

FOREIGN PATENT DOCUMENTS

| | | |
|---|---|---|
| JP | A-56-11461 | 2/1981 |
| JP | B2-62-39428 | 6/1981 |
| JP | A-62-39879 | 2/1987 |
| JP | A-6-148935 | 5/1994 |
| JP | A-9-34163 | 2/1997 |
| JP | A-2001-117268 | 4/2001 |
| JP | A-2004-50478 | 2/2004 |
| JP | A-2004-138920 | 5/2004 |
| JP | A-2004-206081 | 7/2004 |
| JP | A-2005-37429 | 2/2005 |
| JP | A-2008-97041 | 4/2008 |
| JP | A-2008-116948 | 5/2008 |
| JP | B2-4142855 | 9/2008 |

* cited by examiner

*Primary Examiner* — Jonathan Jelsma
(74) *Attorney, Agent, or Firm* — Oliff & Berridge, PLC

(57) ABSTRACT

An electrostatic latent image developing toner includes a mother particle which contains a coloring agent, a release agent and a binder resin; and an inorganic particle which is added to the surface of the mother particle, and wherein a relation between a relaxation time t and a relaxation modulus G(t) which are determined from the dynamic viscoelasticity measurement made on the toner satisfies the following equations (1) and (2);

$$G(t1)<100\ \text{Pa} \quad (1)$$

$$515<(G(t2)-G(t1))/(\log(t1)-\log(t2))<1{,}230 \quad (2)$$

wherein t1 represents the maximum relaxation time and t2 represents the minimum relaxation time.

15 Claims, 3 Drawing Sheets

ELECTROSTATIC LATENT IMAGE DEVELOPING TONER, ELECTROSTATIC LATENT IMAGE DEVELOPER, TONER CARTRIDGE, PROCESS CARTRIDGE AND IMAGE FORMING APPARATUS

CROSS-REFERENCE TO RELATED APPLICATIONS

This application is based on and claims priority under 35 USC 119 from Japanese Patent Application No. 2010-69812 filed on Mar. 25, 2010.

BACKGROUND

1. Technical Field

The present invention relates to electrostatic latent image developing toner, an electrostatic latent image developer, a toner cartridge, a process cartridge and image forming apparatus.

2. Related Art

Methods of visualizing image information via electrostatic images (electrostatic latent images), such as electrophotography, are utilized at present in various fields.

In electrophotography, a method of visualizing image information through a plurality of process steps has been commonly adopted until now, and the process steps include forming electrostatic latent images on a photoreceptor or an electrostatic recording medium by use of one among known instruments, making charge-detectible particles referred to as toner (electrostatic latent image developing toner) adhere to the electrostatic latent images, thereby developing the electrostatic latent images (forming toner images), transferring the toner images to the surface of a transfer-receiving material and fixing the toner image by heating or the like.

By the way, a general method for lowering a temperature for toner fixing is known to use crystalline resins low in melting temperature as binder resins.

SUMMARY

According to an aspect of the invention, there is provided an electrostatic latent image developing toner comprising a mother particle which contains a coloring agent, a release agent and a binder resin; and an inorganic particle that is added to the surface of the mother particle, and wherein a relation between a relaxation time t and a relaxation modulus G(t) which are determined from the dynamic viscoelasticity measurement made on the toner satisfies the following equations (1) and (2);

$$G(t1)<100\ \text{Pa} \quad (1)$$

$$515<(G(t2)-G(t1))/(\log(t1)-\log(t2))<1{,}230 \quad (2)$$

wherein t1 represents the maximum relaxation time and t2 represents the minimum relaxation time.

BRIEF DESCRIPTION OF THE DRAWINGS

Exemplary embodiment(s) of the present invention will be described in detail based on the following figures, wherein;

FIG. 3 is a schematic structural diagram showing one suitable example of a process cartridge which holds the electrostatic latent-image developer relating to an exemplary embodiment of the invention, wherein

Figure 1:
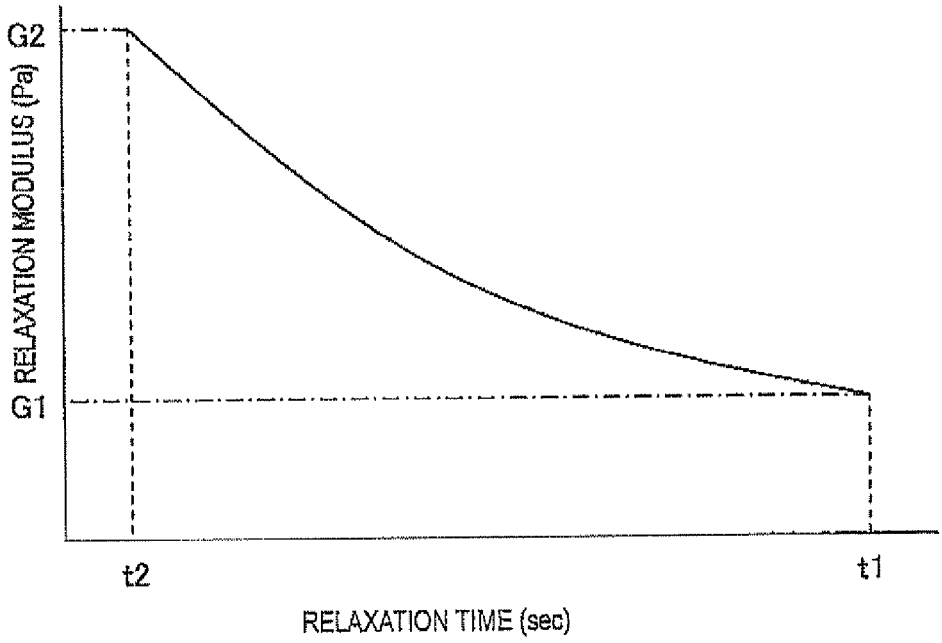
FIG. 1 is an explanatory diagram of a relationship between relaxation time and relaxation modulus.

1Y, 1M, 1C, 1K, 107 denote a photoreceptor (latent image holding member); 2Y, 2M, 2C, 2K, 108 denote a charging roller; 3Y, 3M, 3C, 3K denote laser beam; 3 denotes exposure device; 4Y, 4M, 4C, 4K, 111 denote developing device (development unit); 5Y, 5M, 5C, 5K denote primary transfer roller; 6Y, 6M, 6C, 6K, 113 denote photoreceptor cleaning device (cleaning unit); 8Y, 8M, 8C, 8K denote toner cartridge; 10Y, 10M, 10C, 10K denote image forming unit; 20 denotes intermediate transfer belt; 22 denotes drive roller; 24 denotes support roller; 26 denotes secondary transfer roller (transfer unit); 28, 115 denote fixing device (fixing unit); 30 denotes intermediate transfer-belt cleaning device; 112 denotes transfer device; 116 denotes installation rail; 117 denotes opening for static-charge neutralization exposure; 118 denotes opening for exposure; 200 denotes process cartridge; P, 300 denote recording paper (transfer receiving material).

DETAILED DESCRIPTION

Modes for carrying out of the invention (hereafter described as exemplary embodiments of the invention) are illustrated below.

<Electrostatic Latent Image Developing Toner>

The electrostatic latent image developing toner as an exemplary embodiment of the invention (which may be simply referred to as "toner" hereinafter) is a toner which contains a mother particle which contains a coloring agent, a release agent and a binder resin; and an inorganic particle which is added to the surface of the mother particle, and wherein a relation between a relaxation time t and a relaxation modulus G(t) which are determined from the dynamic viscoelasticity measurement made on the toner satisfies the following equations (1) and (2);

$$G(t1)<100\ \text{Pa} \quad (1)$$

$$515<(G(t2)-G(t1))/(\log(t1)-\log(t2))<1{,}230 \quad (2)$$

wherein t1 represents the maximum relaxation time and t2 represents the minimum relaxation time.

Relaxation modulus and relaxation time measurements are made in accordance with the frequency dispersion measuring method based on a sine-wave vibration technique. In the same manner as described above, the toner is shaped into tablets with a molding machine and set in a 25-mm-dia parallel plate. Thereto, after the normal force is adjusted to zero, sine-wave vibrations are applied at vibration frequencies ranging from 0.1 rad/sec to 100 rad/sec. The measurements are initiated at 100° C., and made continuously until the temperature goes up to 160° C. The measurement interval is set at 30 seconds, and the amount of distortion at each temperature during the measurement is adjusted as appropriate every time the measurement is made in order to ensure appropriate measured values, namely values within detection limits of the rheometer used. The relaxation modulus and the relaxation time are determined from measurement results obtained at those various measurement temperatures.

According to the toner's makeup described above as an exemplary embodiment of the invention, it becomes possible to achieve reductions in glossiness rise and uneven gloss of fixed images over a wide range of fixing speeds (paper-feeding speeds at the time of fixing images by heating), from low to high fixing speeds, and a reduction in amount of heat required at the time of fixing images. Reasons for the possibility of such reductions in view of viscoelastic properties are as follows.

Generally, a phenomenon in which, when a solid is kept in a state of being distorted to some degree by applying an external force thereto, stress produced by such distortion decreases with the passage of time thereafter is referred to as stress relaxation, and the time as a measure of slowness with which the stress decreases as time goes by is referred to as a relaxation time. When a viscoelastic substance, such as toner in particular, undergoes some degree of distortion, the stress caused therein decreases exponentially. In this case, the time t required for the stress to be reduced to 1/e the initial value thereof is the relaxation time and the ratio of the stress to the distortion at this time is referred to as a relaxation modulus.

When the toner as an exemplary embodiment of the invention is fixed to a recording medium such as paper (a transfer receiving material), not only heat but also pressure is applied to the toner from a fixing device, and thereby the toner develops distortions. The behavior of toner fixing can therefore be described by the use of viscoelastic properties including the stress relaxation, and these properties are greatly affected by the viscoelasticity of binder resin and the amounts and sizes of a coloring agent, a release agent and additives dispersed into the binder resin.

In a process step of fixing toner images to a recording medium (a transfer-receiving material), the recording medium on the surface of which toner images are formed is heated e.g. in a state of being sandwiched between fixing members, and thereby the binder resin in toner is melted. At this time, when there are e.g. projections and depressions on the image forming surface of the recording medium, toner on the projections receives greater pressure from the fixing members than toner on the depressions. As a result, only the toner on the projections is crushed flat, thereby forming smoothed areas and partly causing a too great rise in glossiness. Thus, there may be cases where unevenness in gloss develops. Further, when such a too great rise in glossiness occurs, there may be cases where images formed by using black toner in particular seem glary.

In every exemplary embodiment of the invention, however, the binder resin has such a configuration as to include domains of ionic cross-link structure in a scattered state. In a fixing process step, when the toner on a recording medium is sandwiched between fixing members and thereto pressure is applied under heating, the binder resin is melted, but the domains of ionic cross-link structure keep their shapes without melting. This situation means that the relaxation time of the domain is longer than that of the binder resin. After fixing, asperities responsive to the sizes of domains of ionic cross-link structure are therefore formed on the surface of the toner fixed to the recording medium.

In addition, tang δ (loss tangent) concerning viscoelasticity is a ratio between storage modulus G' and loss modulus G" (G"/G'), and therefore the greater the tang δ of a substance, the stronger viscosity the substance tends to have, and conversely the smaller the tang δ of a substance, the stronger elasticity the substance tends to have. In the case of toner, the value of tang δ is greatly affected by the molecular weight distribution of a binder resin, the degree of cross-linking in a binder resin and the dispersion structure of ingredients in toner; as a result, the tang δ value becomes one control factor deciding the glossiness of fixed toner images. According to exemplary embodiments of the invention in particular, the glossiness is greatly affected by the ionic cross-link structure of the binder resin in the toner, and the control of tang δ is therefore of importance.

In exemplary embodiments of the invention, the degree of ionic cross-links is controlled by tan δ determined from temperature sweep test on dynamic viscoelasticity measurement made on the toner at temperature of 80 to 140° C. and at a frequency of 1 Hz. When the value of tang δ is from 1.10 to 1.40 or from about 1.10 to about 1.40, the sizes of domains of ionic cross-link structure is greater than the wavelengths of visible radiation, and there occurs scatter reflections of visible radiation from the toner surface, and thereby the glossiness is kept low. Thus, even when a recording medium having projections and depressions on its surface is used, partial increases in glossiness are inhibited because asperities on the surface of toner are retained, irrespective of whether the toner is fixed to projections or depressions on the recording medium, and unevenness in gloss is reduced throughout the fixed images. On the other hand, when the value of tango is smaller than 1.10 or smaller than about 1.10, the sizes of domains of ionic cross-link structure becomes greater, the fixed color images is poor in ability to develop color. Contrary to such a case, when the value of tang δ is greater than 1.40 or greater than about 1.40, the sizes of domains of ionic cross-link structure becomes smaller and the proportion of the domains scattered in the binder resin becomes small to result in a rise in glossiness and easy development of unevenness in gloss.

In order to adjust the value of tang δ to the range specified above, the distribution and content of a metal element forming the ionic cross-link structure, such as Al element, are controlled in exemplary embodiments of the invention.

Because the toner has the foregoing makeup in exemplary embodiments of the invention, a rise in glossiness and unevenness in gloss of fixed images are also reduced even in cases where images fixed by use of fixing members with thin elastic layers (e.g. 1 mm or below in thickness) or without any elastic layer for the purpose of increasing the image fixing speed.

More specifically, in the case of using a fixing member of such structure as to include a substrate, an elastic layer and a surface layer, the material used for the elastic layer is a material which resists heat conduction, such as rubber, and it is therefore preferable that the elastic layer is thinned in order not to lower the temperature of areas to be fixed when the image fixing speed (process speed) is picked up. On the other hand, by the use of a fixing member whose elastic layer is from 0 mm to 1 mm in thickness (namely, a fixing member having no elastic layer or a fixing member having a thin elastic layer), the fixing member surface becomes hard, and the pressure applied to toner becomes great as compared with the case of using a fixing member having a thick elastic layer. Herein, the use of toner whose makeup is free of domains of ionic cross-link structure results in the toner on projections of a recording medium being crushed flat by the pressure and thereby causes a partial rise in glossiness. On the other hand, the toner's binder resin relating to every exemplary embodiment of the invention, as mentioned above, includes domains of ionic cross-link structure, and these domains retain their shapes without being melted in the fixing process step. Thus, the domains of ionic cross-link structure are resistant to crushing, and asperities on the toner surface are retained; as a result, a rise in glossiness and unevenness in gloss can be reduced. Thus, even when a fixing member whose elastic layer is from 0 mm to 1 mm in thickness is used, a rise in glossiness of fixed images is minimized, and unevenness in gloss is reduced.

Additionally, in every exemplary embodiment of the invention, the relaxation modulus is in the range expressed by the relations (1) and (2), and thereby images are fixed without loss of low-temperature fixability even in a condition that the amount of heat applied at the time of fixing is limited (e.g. in a low-temperature condition that the fixing temperature is 150° C. or below).

An explanatory diagram of the relationship between relaxation time and relaxation modulus is shown in FIG. 1. The relationship shown in FIG. 1 is determined by conversion from a master curve obtained by measuring temperature-frequency dependence characteristics with a viscoelasticity measuring apparatus. The maximum relaxation time t1 and the minimum relaxation time t2 included in the relations (1) and (2) are, as shown in FIG. 1, times at the right end and the left end, respectively, on the graph obtained by plotting relaxation time of the toner (as abscissa) and relaxation modulus (as ordinate), and they are values determined by the viscoelasticity measurement condition adopted. In addition, the relaxation moduli at the maximum relaxation time t1 and the minimum relaxation time t2, respectively, are G(t1) and G(t2). Since changes of t1 and t2 are not great when the viscoelasticity is measured under the same condition, noteworthy points on the graph shown in FIG. 1 are the values of relaxation modulus at their respective relaxation times.

In order to attain some measure of fixing properties in response to the appropriate model of a fixing device, it is usually a common practice in the case of toner to allow the range of relaxation modulus to have values within certain bounds, and it is required for toner to retain some degree of relaxation modulus during given fixing time. Therefore the value of G(t1) in the relation (1) is defined as a value smaller than 100 Pa. In cases where the value of G(t1) is 100 Pa or above, there is possibility that toner cannot have a sufficient ability to be fixed under low temperatures.

Further, since the relaxation modulus is a ratio of stress to distortion as mentioned above, a larger range of relaxation modulus values, namely G(t2)−G(t1) in the relation (2), is preferred in order to obtain toner having high degree of flexibility in fixing properties, irrespective of fixing speed. However, it is required to define the upper limit of the value of G(t2)−G(t1) from the viewpoint of aiming at compatibility between low-temperature fixability and other fixing properties (image glossiness and hot offset property). Thus suitable glossiness and fixability can be achieved by adjusting the value of dt×10, wherein dt stands for a fixing time (dwell time), to be variable within a range from t1 to t2 and by controlling the relaxation modulus to fall within such a range. When the value of ((G(t2)−G(t1))/(log(t1)−log(t2)) in the relation (2) is 515 or below, there is a possibility that the toner is applicable only to fixing machines having limited fixing speeds; while, when the value is 1,230 or above, there is a possibility that the toner cannot achieve either suitable fixability or suitable glossiness. Therefore satisfaction of both the requirements defined by the relations (1) and (2) allows compatibility between low-temperature fixability and gloss controllability over a wide range of fixing speeds from low speeds to high speeds.

For the binder resin in every exemplary embodiment of the invention, it is preferable to use a crystalline polyester resin. By containing a crystalline polyester resin, the electrostatic latent-image developer can deliver excellent low-temperature fixability over a wide range of fixing speeds from low speeds to high speeds.

In addition, it is preferable that, when the mother particles of the toner relating to every exemplary embodiment of the invention are subjected to 10-second argon etching by means of photoelectron spectroscopic apparatus, Al element is detected in an amount of 2.0 atomic % or below or about 2.0 atomic % or below. By satisfying this condition, the value of tang δ can be adjusted to the range specified above. The Al element detected when 10-second argon etching is performed with photoelectron spectroscopic apparatus is Al element ascribable to ionic cross-link structure present in the neighborhood of the toner surface, and therefore the Al element detected in an amount greater than 2.0 atomic % or greater than about 2.0 atomic % results in an increase in size of the ionic cross-link structure or an increase in proportion of scattered ionic cross-link structures, thereby rendering the glossiness of fixed image too low or requiring greater amount of heat at the time of fixing. Thus, there is a fear of degradation in low-temperature fixability.

Each of various ingredients which constitute the toner is described below in detail.

<Binder Resin>

The binder resin relating to every exemplary embodiment of the invention preferably contains a polyester resin. By way of example of the polyester resin, crystalline polyester resin and amorphous polyester resin can be mentioned. And it is far preferable that the binder resin contains a crystalline polyester resin, an amorphous polyester resin. As the binder resin, it can be used combination of crystalline polyester resin and amorphous polyester resin. Detailed explanations of crystalline and amorphous polyester resins each are given below.

Crystalline Polyester Resin:

As to polymerizable monomer elements constituting a crystalline polyester resin, polymerizable monomers having straight-chain aliphatic components are preferable to those having aromatic components because of their easiness of crystal structure formation. Furthermore, in order not to impair their crystallizing property, it is preferred that each of constituents derived from polymerizable monomers be incorporated into a polymer in a proportion of at least 30 mol % on a single-species basis. For the crystalline polyester resin, it is essential to have two or more different polymerizable monomeric species as its constituents, and it is preferable that each essential constituent derived from a certain polymerizable monomeric species has the same structural proportion as the above (at least 30 mol %).

The melting temperature of a crystalline polyester resin is preferably in a range from 50° C. to 100° C. or from about 50° C. to about 100° C., far preferably in a range from 55° C. to 90° C. or from about 55° C. to about 90° C., further preferably in a range from 60° C. to 85° C. or from about 60° C. to about 85° C. When the melting temperature is below 50° C. or below about 50° C., there may occur degradation in storability of toner, such as blocking of stored toner, and degradation in storability of fixed images after fixing is completed (a problem that fixed images stick to the background or the back of paper, or fixed images stick together, namely the so-called document offset problem, a problem that fixed images are transferred to a polyvinyl chloride sheet, or the polyvinyl chloride offset problem, and so on). On the other hand, when the melting temperature is higher than 100° C. or higher than about 100° C., there may be cases where sufficient low-temperature fixability cannot be attained.

By the way, the melting temperature of the crystalline polyester resin can be determined as the peak temperature of an endothermic peak obtained by differential scanning calorimetry (DSC).

The term "crystalline polyester resin" used in every exemplary embodiment of the invention is intended to include not only a polymer whose constituents are 100% polyester in their structure but also a polymer formed by elements to constitute polyester and other elements being polymerized together (copolymer). In the latter case, however, the proportion of polymer's (copolymer's) constituents other than polyester is controlled to 50 mass % or below.

The crystalline polyester resin can be synthesized e.g. from a polycarboxylic acid element and a polyhydric alcohol element. By the way, in using a crystalline polyester resin in every exemplary embodiment of the invention, the crystalline polyester resin may be of commercial origin, or it may be synthesized.

Examples of the polycarboxylic acid element include aliphatic dicarboxylic acids, such as oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid and 1,18-octadecanedicarboxylic acid; and aromatic dicarboxylic acids, such as phthalic acid, isophthalic acid, terephthalic acid, naphthalene-2,6-dicarboxylic acid, malonic acid, mesaconic acid and other dibasic acids. Those examples may further include anhydrides and lower alkyl esters of those acids, but are not limited to the recited ones.

Examples of tricarboxylic to polycarboxylic acid elements include 1,2,4-benzeneticarboxylic acid, 1,2,5-benzenenicarboxylic acid, 1,2,4-naphthalenetricarboxylic acid, and anhydrides and lower alkyl esters of these acids. These acids, and anhydrides and lower alkyl esters of these acids may be used alone or as combinations of two or more kinds.

In addition to the aliphatic dicarboxylic acids and the aromatic dicarboxylic acids as recited above, dicarboxylic acid elements having sulfonic acid groups may be included in polycarboxylic acid elements.

In addition to the aliphatic dicarboxylic acids and the aromatic dicarboxylic acids as recited above, dicarboxylic acid elements having double bonds may further be included in polycarboxylic acid elements.

The polyhydric alcohol element is preferably an aliphatic diol, far preferably a straight-chain aliphatic dial having 7 to 20 carbon atoms in its main chain. When the aliphatic dial is a branched-chain type, there may be cases where the crystallizing property of the polyester resin is degraded and the melting temperature is lowered. On the other hand, when the number of carbons in the main chain is smaller than 7, the polycondensation of such an aliphatic dial and aromatic dicarboxylic acid may bring about a rise in melting point and may render low-temperature fixing difficult; while, when the number of carbons in the main chain is greater than 20, procurement of practical materials tends to become difficult. And it is far preferable that the number of carbons in the main chain is 14 or below.

Examples of an aliphatic dial which can be used suitably for syntheses of crystalline polyester resins include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol and 1,14-eicosanediol, but they are not limited to these diols. Of these dials, 1,8-octanediol, 1,9-nonanediol and 1,10-decanediol are preferred over the others in view of availability.

In addition, trihydric and higher alcohol compounds are also usable as polyhydric alcohol elements, with examples including glycerin, trimethylolethane, trimethylolpropane and pentaerythritol. These polyhydric alcohol compounds may be used alone or as combinations of two or more kinds.

Those aliphatic dials make up preferably at least 80 mol %, far preferably at least 90 mol %, of the polyhydric alcohol compounds. When the aliphatic dial content is lower than 80 mol %, the polyester resin obtained is low in crystallinity, and thereby the melting temperature thereof is depressed. There may thus occur deteriorations in toner-blocking resistance, image keeping quality and low-temperature fixability.

Additionally, for the purpose of adjusting an acid value and a hydroxyl value as required, polycarboxylic acids and polyhydric alcohol compounds may be added at the final stage of synthesis. Examples of polycarboxylic acids include aromatic carboxylic acids, such as terephthalic acid, isophthalic acid, phthalic acid anhydride, trimellitic acid anhydride, pyromellitic acid and naphthalenedicarboxylic acid; aliphatic carboxylic acids, such as maleic acid anhydride, fumaric acid, succinic acid, alkenylsuccinic anhydride and adipic acid; and alicyclic carboxylic acids, such as cyclohexanedicarboxylic acid.

Production of the crystalline polyester resins is carried out under a polymerization temperature of 280° C. to 230° C., and the reaction is made to proceed as water or alcohol produced at the time of condensation is removed by reducing the inside pressure of a reaction system used, if needed.

When polymerizable monomers insoluble or incompatible under reaction temperatures are used, addition of a high-boiling solvent as a dissolving assistant can bring such monomers to a dissolved state. And the polycondensation reaction proceeds as the dissolving assistant is distilled away. When a polymerizable monomer poor in compatibility is present in copolymerization reaction, it is appropriate that the polymerizable monomer poor in compatibility and an acid or alcohol to be subjected to polycondensation reaction therewith be made to undergo condensation in advance, and then subjected to polycondensation reaction with main ingredients.

Examples of a catalyst usable on the occasion of the production of the polyester resins include compounds of alkali metals such as sodium and lithium, compounds of alkaline earth metals such as magnesium and calcium, compounds of such metals as zinc, manganese, antimony, titanium, tin, zirconium and germanium; phosphorus acid compounds, phosphoric acid compounds and amine compounds.

The acid value of a crystalline polyester resin (the quantity of KOH required for neutralization of 1 g of the resin, which is expressed in mg) is preferably in a range from 3.0 mg KOH/g to 30.0 mg KOH/g or from about 3.0 mg KOH/g to about 30.0 mg KOH/g, far preferably in a range from 6.0 mg KOH/g to 25.0 mg KOH/g or from about 6.0 mg KOH/g to about 25.0 mg KOH/g, further preferably in a range from 8.0 mg KOH/g to 20.0 mg KOH/g or from about 8.0 mg KOH/g to about 20.0 mg KOH/g.

When the acid value is lower than 3.0 mg KOH/g or lower than about 3.0 mg KOH/g, dispersibility in water is lowered, and therefore there may be cases where it becomes difficult to form emulsified particles by a wet manufacturing method. In addition, the stability of emulsified particles is seriously lowered at the time of aggregation, and therefore there may be oases where it becomes difficult to make toner with efficiency. On the other hand, when the acid value exceeds 30.0 mg KOH/g or exceeds about 30.0 mg KOH/g, the toner obtained increases in hygroscopicity, and thereby may become susceptible to environments in which the toner is usually placed.

In addition, the weight-average molecular weight (Mw) of a crystalline polyester resin is preferably from 6,000 to 35,000 or from about 6,000 to about 35,000. It is far preferable that the weight-average molecular weight (Mw) of a crystalline polyester resin is from 10000 to 32000. When the weight-average molecular weight (Mw) is lower than 6,000 or lower than about 6,000, the toner obtained soaks into the surface of a recording medium such as paper at the time of fixing, and thereby it may develops unevenness in fixing or may lower strength to bending resistance of fixed images. On the other hand, when the weight-average molecular weight (Mw) exceeds 35,000 or exceeds about 35,000, there may be cases where the viscosity at the time of melting becomes too high, and temperatures at which the viscosity reaches values suitable for fixing become high to result in impairment of low-temperature fixability.

The weight-average molecular weight measurement is made by gel permeation chromatography (GPC). The molecular weight measurement by GPC is performed using a GPC system HLC-8120, made by TOSOH CORPORATION, as measuring apparatus, a column TSK gel Super HM-M (15 cm), made by TOSOH CORPORATION, and THF as a solvent. The weight-average molecular weight is calculated from this measurement result with the aid of the molecular-weight calibration curve made up with monodisperse polystyrene standard samples.

The crystalline polyester resin content of the toner is preferably in a range from 3 mass % to 40 mass % or from about 3 mass % to about 40 mass %, far preferably in a range from 4 mass % to 35 mass % or from about 4 mass % to about 35 mass %, further preferably in a range from 5 mass % to 30 mass % or from about 5 mass % to about 30 mass %. When the crystalline polyester resin content is lower than 3 mass % or lower than about 3 mass %, there may be cases where sufficient low-temperature fixability is not be attained; while, when the content is higher than 40 mass % or higher than about 40 mass %, there may be cases where sufficient toner strength and fixed image strength are not achieved and adverse effects on chargeability are also produced.

It is preferable that crystalline resins including the crystalline polyester resins contain as main ingredients (with a content of 50 mass % or above) crystalline polyester resins synthesized using polymerizable aliphatic monomers (which May also be referred to as "crystalline aliphatic polyester resins" hereinafter). Moreover, it is far preferred in this case that the structural proportion of polymerizable aliphatic monomers which make up the crystalline aliphatic polyester resin be 60 mol % or above, preferably 90 mol % or above. Additionally, those used suitably as the polymerizable aliphatic monomers are aliphatic diols and aliphatic dicarboxylic acids.

Amorphous Polyester Resin:

As examples of amorphous polyester resins which are preferably used in every exemplary embodiment of the invention, those produced by polycondensation of polycarboxylic acids and polyhydric alcohol compounds can be given.

Examples of the polycarboxylic acids and the polyhydric alcohol compounds include the same ones as recited for the crystalline polyester resins.

The glass transition temperatures (Tg) of the amorphous polyester resins are preferably in a range from 50° C. to 80° C. When the Tg value is lower than 50° C., there may be cases where the keeping quality of the toner and that of fixed images are degraded. When the Tg value is higher than 80° C., on the other hand, there may be cases where the toner defies fixing at low temperatures in contrast to traditional ones. Additionally, it is far preferred that the Tg values of the amorphous polyester resins be from 50° C. to 65° C.

Production of the amorphous polyester resins is carried out by modeling after the case of the crystalline polyester resins.

From the viewpoint of enhancing fixability of images, the softening temperature (flow tester ½ depression temperature) of binding resins including both the crystalline and amorphous polyester resins is preferably from 90° C. to 140° C., far preferably from 100° C. to 135° C., further preferably from 100° C. to 120° C.

In addition, it is preferable that the binding resins are soluble in tetrahydrofuran. Herein, the expression "soluble in tetrahydrofuran" refers to a state that, when binding resins in an amount of 1 g are added to 10 ml tetrahydrofuran and subjected to 5-minute dispersion by means of an ultrasonic dispersing machine at 25° C., the resins dissolve in tetrahydrofuran.

<Coloring Agent>

The toner may contain a coloring agent as required. The coloring agent, though it may be either a dye or a pigment, is preferably a pigment in terms of light fastness and water resistance.

Pigments usable as coloring agents in exemplary embodiment of the invention are e.g. as follows. Examples of a yellow pigment include chrome yellow, zinc yellow, yellow iron oxide, cadmium yellow, Chrome Yellow, Hansa Yellow, Hansa Yellow 10G, Benzidine Yellow G, Benzidine Yellow GR, Threne Yellow, Quinoline Yellow and Permanent Yellow NCG. To be more specific, C.I. Pigment Yellow 74, C.I. Pigment Yellow ISO, C.I. Pigment Yellow 93 and the like are usable, and C.I. Pigment Yellow 74 is preferable to the others in point of pigment dispersibility. The yellow pigments recited above can be used alone or as combinations of two or more thereof.

Examples of a black pigment include carbon black, copper oxide, manganese dioxide, Aniline Black, activated carbon, nonmagnetic ferrite and magnetite.

Examples of an orange pigment include chrome orange, molybdenum orange, Permanent Orange GTR, Pyrazolone Organe, Vulcan Orange, Benzidine Orange GC, Indanthrene Brilliant Orange RK and IndanthreneBrilliant Orange CK.

Examples of a red pigment include iron red, cadmium red, red lead, red mercury sulfide, Watchung Red, Permanent Red 4R, Lithol Red, Brilliant Carmine 3B, Brilliant Carmine 6B, Dupont Oil Red, Pyrazolone Red, Rhodamine B Lake, Lake Red C, Rose Bengale, Eosine Red and alizarin lake.

Examples of a blue pigment include Prussian blue, cobalt blue, Alkali Blue Lake, Victoria Blue Lake, Fast Sky Blue, Indanthrene Blue BC, Aniline Blue, Ultramarine Blue, Calco Oil Blue, Methylene Blue chloride, Phthalocyanine Blue, Phthalocyanine Green, Malachite Green oxalate.

Examples of a violet pigment include manganese violet, Fast Violet B and Methyl Violet Lake.

Examples of a green pigment include chromium oxide, Chrome Green, Pigment Green, Malachite Green Lake and Final. Yellow Green G.

Examples of a white pigment include hydrozincite, titanium oxide, antimony white and zinc sulfide.

Examples of a body pigment include barite powder, barium carbonate, clay, silica, white carbon, talc and alumina white.

Dyes can also be used as a coloring agent as required. The dyes usable as a coloring agent are various kinds of dyes such as basic, acidic, disperse and direct dyes, with examples including Nigrosine, Methylene Blue, Rose Bengale, Quinoline Yellow and Ultramarine Blue. These dyes can be used alone, or as mixtures of two or more thereof, or in a state of solid solution.

The coloring agent as recited above can be dispersed according to known methods. Therein, it is appropriate to use e.g. a dispersing machine of media system, such as a rotational-shear homogenizer, a ball mill, a sand mill or an attrition mill, or a dispersing machine of high-pressure head-on collision system.

Alternatively, such a coloring agent may be dispersed into an aqueous-based solvent by use of a polar surfactant and a homogenizer of the foregoing type.

The coloring agent is selected in terms of hue angle, color saturation, brightness, weather resistance, dispersibility in toner and so on. The amount of the coloring agent added is preferably from 1 part by mass to 20 parts by mass per 100 parts by mass of resin.

<Release Agent>

The toner may contain a release agent as required. Examples of the release agent include low-molecular-weight polyolefins, such as polyethylene, polypropylene and polybutene; silicones having softening temperatures; fatty acid amides, such as oleic acid amide, erucic acid amide, ricinoleic acid amide and stearic acid amide; vegetable wax, such as carnauba wax, rice wax, candelilla wax, Japan wax and jojoba oil; animal wax, such as beeswax; mineral wax and petroleum wax, such as montan wax, ozocerite, ceresin, paraffin wax, microcrystalline wax and Fischer-Tropsch wax; ester wax produced from higher fatty acid and higher alcohol, such as stearyl stearate and behenyl behenate; ester wax produced from higher fatty acid and monohydric or polyhydric lower alcohol, such as butyl stearate, propyl oleate, monostearoylglyceride, distearoylglyceride and pentaerythritol tetrabehenate; ester wax produced from higher fatty acid and polyhydric multimeric alcohol, such as diethylene glycol monostearate, dipropylene glycol distearate, distearoyldiglyceride and tetrastearoyltriglyceride; ester wax produced from sorbitan and higher fatty acid, such as sorbitan monostearate; and ester wax produced from cholesterol and higher fatty acid, such as cholesteryl stearate. These release agents may be used alone or as combinations of two or more thereof.

The melting temperature of such a release agent is preferably from 50° C. to 100° C., or from about 50° C. to about 100° C., far preferably from 60° C. to 95° C. or from about 60° C. to about 95° C.

The release agent content of the toner is preferably from 0.5 mass % to 15 mass % or from about 0.5 mass % to about 15 mass %, far preferably from 1.0 mass % to 12 mass % or from about 1.0 mass % to about 12 mass %. When the release agent content is below 0.5 mass % or below about 0.5 mass %, the toner may suffer release failure, notably in oil-less fixing. When the release agent content exceeds 15 mass % or exceeds about 15 mass %, the flowability of the toner may worsen, and there may occur deterioration in image quality and reliability of image formation.

<Other Additives>

Besides containing the ingredients recited above, the toner may contain various other ingredients, such as an internal additive, a charge controlling agent, inorganic powder (inorganic particles) and organic particles, on an as needed basis.

It is appropriate that the inorganic particles and the organic particles be added to the toner particle surface under application of shear.

Examples of the internal additive include magnetic substances, such as ferrite, magnetite, reduced iron, metals such as cobalt, manganese and nickel, alloys of these metals, and compounds containing these metals, and these internal additives each are used in such an amount as not to impair charging capability.

The charge controlling agent has no particular restriction. However, in the ease of using color toner in particular, colorless or light-colored one is preferably used. Examples of such a charge controlling agent include quaternary ammonium salt compounds, nigrosine compounds, dyes containing complexes of aluminum, iron, chromium and the like, and triphenylmethane pigments. From the viewpoints of controlling ionic strength which affects stability at the time of such aggregation, fusion and coalescence as described later and reducing wastewater pollution, materials which resist being dissolved in water are preferable.

The inorganic particles, though added for various purposes, may be added for the purpose of making an adjustment to viscoelasticity of the toner. By this viscoelasticity adjustment, image glossiness and infiltration of toner into paper can be controlled. As such inorganic particles, known ones including silica particles, titanium oxide particles, alumina particles, cerium oxide particles and the particles obtained by treating those particle surfaces so as to have hydrophobicity may be used alone or as combinations of two or more thereof. However, from the viewpoint of not impairing ability to develop color and transparency, such as perviousness of OHP (overhead projector) sheet to light, silica particles are preferably used because of their refractive index smaller than binder resins. In addition, the silica particles may undergo a variety of surface treatment, such as surface treatment with a silane coupling agent, a titanate coupling agent or silicone oil.

The inorganic particles and the organic particles are external additives which are externally added to the toner surface and, more specifically, include the following ones.

Examples of the inorganic particles include silica, alumina, titanium oxide, barium titanate, magnesium titanate, calcium titanate, strontium titanate, zinc oxide, silica sand, clay, mica, wollastonite, diatomaceous earth, cerium chloride, red iron, chromium oxide, cerium oxide, antimony trioxide, magnesium oxide, zirconium oxide, silicon carbide and silicon nitride. Of these particles, silica particles and titanium oxide particles, notably those having undergone treatment for rendering the particle surface hydrophobic (surface treatment), are preferred over the others.

The inorganic particles are generally used for the purpose of enhancing flowability. The primary particle diameter of the inorganic particles is preferably in a range from 1 nm to 200 nm, and the amount of inorganic particles added is preferably in a range from 0.01 parts by mass to 20 parts by mass per 100 parts by mass of the toner.

The organic particles are generally used for the purpose of enhancing toner's suitability for cleaning as well as transfer, with examples including powdered fluoropolymer such as powdered polyvinylidene fluoride or polytetrafluoroethylene, metal salt of fatty acid such as zinc stearate or calcium stearate, polystyrene and polymethyl methacrylate. The amount of the organic particles added to the toner, though it has no particular limitation, is preferably in a range from 0.1 mass % to 10 mass %, far preferably in a range from 0.2 mass % to 8 mass %.

<Characteristics of Toner>

The viscoelastic characteristic in the invention is determined with a rheometer (ARES rheometer, made by Rheometric Scientific, Inc.). The determination procedure is explained later in Example.

The suitable volume-average particle diameter of the toner is in a range from 4 μm to 9 μm or from about 4 μm to about 9 μm, preferably in a range from 4.5 μm to 8.5 μm or from about 4.5 μm to about 8.5 μm, far preferably in a range from 5 μm to 8 μm or from about 5 μm to about 8 μm. When the volume-average particle diameter is smaller than 4 μm or smaller than about 4 μm, toner's flowability is lowered, chargeability of each particle tends to deteriorate and electrification distribution becomes broad, and thereby fogging to the background (a phenomenon that toner flies off to the image background to which normally the toner should not be transferred) and spilling of the toner out of a developing device are apt to occur. In addition, when the volume-average particle diameters are smaller than 4 μm or smaller than about 4 μm, exceptional difficulty in cleaning may come up. On the other hand, when the volume-average particle diameters are greater than 9 μm or greater than about 9 μm, resolution is lowered, and thereby sufficient image quality cannot be achieved and satisfaction of recent high-quality image requirement may become difficult.

The volume-average particle-diameter measurement is made using Multisizer II (a product of Beckman, Coulter Inc) with an aperture setting of 50 μm. On this occasion, the toner is dispersed into an aqueous solution of electrolyte (aqueous solution of ISOTON) by applying thereto ultrasonic waves for 30 seconds or longer, and thereon the measurement is made.

The average roundness of the toner is preferably from 0.95 to 0.985 or from about 0.95 to about 0.985, far preferably from 0.955 to 0.985 or from about 0.955 to about 0.985, further preferably from 0.96 to 0.985 or from about 0.96 to about 0.985.

When the average roundness is below 0.95 or below about 0.95, the irregularity of toner shape becomes great, and the surface area becomes large. When the surface area becomes large, there occurs an increase in electrostatic adhesion power, and thereby the transfer efficiency is lowered to an extreme. In addition, the external additive is unevenly distributed only to depressions on the toner surface, and thereby a substantial function of external additives (impartment of powder flowability, improvement in ability to be cleaned) also deteriorates.

On the other hand, when the average roundness exceeds 0.985 or exceeds 0.985, the toner shape becomes closer to a sphere, and therefore the toner tends to roll and an area of contact between the toner and a transfer medium becomes small, which results in the lowering of transfer efficiency. In addition, when a blade cleaning is carried out, the spherical toner tends to slip from the blade at the cleaning nip section to result in cleaning failure.

The average roundness is preferably measured with FPIA-2100 made by Sysmex Corporation. In this apparatus, the method of making measurements on particles dispersed in water or the like in accordance with flow particle image analysis is adopted, and a particle suspension sucked is conducted to a flat sheath flow cell and formed into a flat sample flow by use of a sheath solution. By exposing the sample flow to strobe light, photographs of in-transit particles are taken as still images with a CCD camera via the objective lens. The particle images obtained by taking photographs are subjected to two-dimensional image processing, and circle equivalent diameters and roundness of the toner particles are calculated from the projected areas and the perimeters. From the shot image of each individual particle, the circle equivalent diameter is calculated as a diameter of the circle having the same area as the two-dimensional image has. As to the roundness, image analysis is made on each of at least 5,000 particles, the analysis data obtained is subjected to statistical processing, and thereby the average roundness is determined.

$$\text{Roundness}=\text{circle equivalent diameter perimeter/perimeter}=[2\times(A\pi)^{1/2}]/PM$$

In the above equation, A represents a projected area and PM represents a perimeter.

In the measurements, the HPF mode (high-resolution mode) is used and the dilution ratio of 1.0 is adopted. And for the purpose of eliminating measurement noises in data analysis, the range selected for the number-mean particle size analysis is from 2.0 μm to 30.1 μm and the range selected for the roundness analysis is from 0.40 to 1.00.

In the case of determining average roundness of mother particles of the toner to which an external additive is attached, the average roundness of mother particles may be determined by measurements after removal of the external additive. However, images of the external additive are out of focus, and therefore the difference between the data obtained from the measurements on the external additive-attached toner and the data obtained from the measurements on the toner's mother particles is within an error range. Thus, even when measurements are made on the toner to which the external additive is attached, the value determined can be regarded as the average roundness of the toner's mother particles.

<Manufacturing Method of Toner>

Next, a manufacturing method of toner is explained. The manufacturing method of the electrostatic latent image developing toner relating to every exemplary embodiment of the invention (hereinafter abbreviated to the present electrostatic-latent-image-developing toner or the present toner) is not limited to a particular one, but since the toner's surface part and the toner's inner part are required to have respectively limited aluminum contents for the purpose of developing the properties of the present toner, the manufacturing method utilizing emulsion aggregation process is preferred because of easiness with which the aluminum contents can be controlled.

The manufacturing method of the present electrostatic latent image developing toner is described in detail according to an emulsion aggregation process.

The manufacturing method of the present electrostatic latent image developing toner is characterized by including an aggregation process in which a dispersion liquid of at least one kind of resin particles and a dispersion liquid of at least one kind of coloring agent are mixed together, and therefrom aggregate particles are formed in the presence of aluminum ions, a fusion process in which the dispersion liquid containing the resin particles is heated to a temperature higher than, the glass transition temperature of the resin particles, and thereby the aggregate particles are fused and coalesced to result in formation of toner particles, and a cleaning process in which the toner particles formed are cleaned.

More specifically, the dispersion liquids used in the manufacturing method are a dispersion liquid in which resin particles generally produced by emulsion polymerization are dispersed with the aid of an ionic surfactant and a dispersion liquid in which a coloring agent is dispersed with the aid of some other ionic surfactant having the opposite polarity. These dispersion liquids are mixed together to cause hetero-aggregation, and thereby aggregate particles having sizes equivalent to particle diameters of toner are formed. Thereafter, the aggregate particles are fused and coalesced by heating to a temperature higher than the glass transition, temperature of the resin, further cleaned, and then dried. In this way, the intended toner is obtained. According to this manufacturing method, various shapes of toner, from toner of indefinite form to toner of spherical form, can be produced. In manufacturing the present toner, a dispersion liquid of release agent particles can further be added.

Although the foregoing manufacturing method is a method of collectively mixing the dispersion liquids as starting materials and causing aggregation and fusion in the mixed dispersion liquid, the manufacturing method including the following steps may be adopted. Specifically, at the initial stage of the aggregation process, the amounts of ionic dispersing agents having opposite polarities are displaced in advance from their balance. This ionic displacement is neutralized e.g. with an inorganic metal salt containing aluminum or a polymer containing at least aluminum, and core aggregate particles are formed at a temperature lower than the glass transition temperature. After the core aggregate particles are stabilized, they are further stabilized as required by shortly heating to a high temperature, but lower than the glass transition temperature or fusion temperature of the resin contained in the core aggregate particles or addition particles. Thereafter, as the second stage, if needed, a particle dispersion liquid whose polarity and amount suffice to compensate for the displacement from the balance is added and subjected to stabilization as required through shortly heating to a high temperature, but lower than the glass transition temperature or fusion temperature of the resin contained in the core aggregate particles or addition particles, and then the particles added at the second stage are fused and coalesced by heating to a temperature higher than the glass transition temperature as they are attached to the surfaces of the core aggregate particles. Each process is detailed below step by step.

The dispersion liquid of resin particles is formed by applying shearing stress to a mixed solution prepared by mixing an aqueous medium and a solution containing a resin and, if needed, a coloring agent (a polymer solution). At this time, heating to a temperature higher than the softening temperature of the resin is carried out, and thereby the disperse system of particles is formed under a condition that the polymer solution is reduced in viscosity.

Examples of a dispersing machine used in forming the dispersion liquid of resin particles include a homogenizer, a pressure kneader, an extruder, and a media-utilized dispersing machine.

An example of a dispersing medium usable for the dispersion liquid of resin particles and the dispersion liquid of a coloring agent, the dispersion liquid of a release agent and other ingredients as described below is an aqueous medium.

Examples of the aqueous medium include water such as distilled water or ion exchange water, and alcohol. These media may be used alone or as combinations of two or more thereof.

In addition, a surfactant may be used for the purpose of stabilizing the dispersed state of each of the dispersion liquids. Examples of such a surfactant include anionic surfactants of sulfuric acid ester type, sulfonate type, phosphoric acid ester type and soap type, cationic surfactants of amine salt type and quaternary ammonium salt type, and non-ionic surfactants of polyethylene glycol type, alkylphenol-ethylene oxide adduct type and polyhydric alcohol type. Of these surfactants, ionic surfactants are preferable to the others, and anionic surfactants and cationic surfactants are far preferable.

In the present toner, it is advantageous to use an anionic surfactant as the surfactant for dispersing a release agent. This is because anionic, surfactants are generally strong in dispersing power and excellent at dispersing resin particles and a coloring agent.

Examples of an anionic surfactant include fatty acid soaps such as potassium laurate, sodium oleate and sodium castor oil, sulfuric acid esters such as octyl sulfate, lauryl sulfate, lauryl ether sulfate and nonyl phenyl ether sulfate, sulfonates such as lauryl sulfonate, dodecylbenzene sulfonate, sodium salts of alkylnaphthalene sulfonic acids including triisopropylnaphthalene sulfonate and dibutylnaphthalene sulfonate, naphthalenesulfonate-formaldehyde condensates, monooctylsulfosuccinate, dioctylsulfosuccinate, lauric acid amide sulfonate and oleic acid amide sulfonate, phosphoric acid esters such as lauryl phosphate, isopropyl phosphate and nonyl phenol ether phosphate, dialkylsulfosuccinic acid salts such as sodium dioctylsulfosuccinate, and sulfosuccinic acid salts such as disodium lauryl sulfosuccinate.

Examples of a cationic surfactant include amine salts such as laurylamine hydrochloride, stearylamine hydrochloride, oleylamine acetate, stearylamine acetate and stearylaminopropylamine acetate, and quaternary ammonium salts such as lauryltrimethylammonium chloride, dilauryldimethylammonium chloride, distearyldimethylammonium chloride, lauryldihydroxyethylmethylammonium chloride, olecylbispolyoxyethylenemethylammonium chloride, lauroylaminopropyldimethylethylammonium ethosulfate, lauroylarlinopropyldimethylhydroxyethylammonium perchlorate, alkylbenzenetrimethylammonium chloride and alkyltrimethylammonium chloride.

Non-ionic surfactants are preferably used in combination with the anionic surfactants or the cationic surfactants as recited above.

Examples of a non-ionic surfactant include alkyl ethers such as polyoxyethylene octyl ether, polyoxyethylene lauryl ether, polyoxyethylene stearyl ether and polyoxyethylene oleyl ether, alkyl phenyl ethers such as polyoxyethylene octyl phenyl ether and polyoxyethylene nonyl phenyl ether, alkyl esters such as polyoxyethylene laurate, polyoxyethylene stearate and polyoxyethyene oleate, alkylamines such as polyoxyethylene laurylamino ether, polyoxyethylene stearylamino ether, polyoxyethylene oleylamino ether, polyoxyethylene soybean amino ether and polyoxyethylene tallow amino ether, alkylamides such as polyoxyethylene lauric acid amide, polyoxyethylene stearic acid amide and polyoxyethylene oleic acid amide, vegetable oil ethers such as polyoxyethylene caster oil ether and polyoxyethylene rapeseed oil ether, alkanolamides such as lauric acid diethanolamide, stearic acid diethanolamide and oleic acid diethanolamide, and sorbitan ester ethers such as polyoxyethylene sorbitan monolaurate, polyoxyethylene sorbitan monopalmitate, polyoxyethylene sorbitan monostearate and polyoxyethylene sorbitan monooleate.

The surfactants may be used alone or as combinations of two or more thereof. And the surfactant content of each dispersion liquid is generally low, and more specifically, it is in a range from 0.01 mass % to 10 mass %, preferably in a range from 0.05 mass % to 5 mass %, far preferably in a range from 0.1 mass % to 2 mass %. When the surfactant content is below 0.01 mass %, all of the dispersion liquid of resin particles, the dispersion liquid of a coloring agent, the dispersion liquid of a release agent and so on become unstable, and there may arise a problem that aggregation is caused or liberation of specific particles occurs under aggregation because of differences of stability among different kinds of particles. On the other hand, surfactant contents exceeding 10 mass % are undesirable, because they become a cause of broad particle-size distribution or make the particle-size control difficult. In general a disperse system of large-size toner produced by suspension polymerization is stable even when a small amount of surfactant is used.

In addition, a hydrophilic polymer in a solid state at ordinary temperature (25° C.) can also be used. Examples of such a polymer include cellulose compounds such as carboxymethyl cellulose and hydroxypropyl cellulose, polyvinyl alcohol, gelatin, starch and gum Arabic.

The volume-average diameter of resin particles in the dispersion liquid of resin particles according to every exemplary embodiment of the invention is 1 μm or below, preferably in a range from 100 nm to 300 nm. When the volume-average particle diameter exceeds 1 μm, there may be cases where the particle size distribution of toner particles obtained by undergoing aggregation and fusion becomes broad and liberation of particles occurs to result in degradation of performance and reliability of the toner obtained. Additionally, the volume-average particle sizes below 100 nm may require much time for aggregation and growth of toner particles, and they are therefore unsuitable from the industrial view point, while the volume-average particle sizes exceeding 300 nm may bring about not only non-uniform dispersion of a release agent and a coloring agent but also difficulties of controlling surface properties of toner particles.

In the aggregation process, all kinds of particles in a mixture of a dispersion liquid of resin particles, a dispersion of a coloring agent and, if needed, a dispersion of a release agent are made to aggregate and formed into aggregate particles. Herein, the aggregate particles are formed through heteroaggregation or the like, and an ionic surfactant differing in polarity from the aggregate particles and a compound having an electrovalence, such as a metal salt, are added for the purpose of stabilizing the aggregate particles and controlling particle sizes and the distribution of particle sizes.

The process may be performed through aggregation by collective mixing as mentioned above, or in the following manner that, at the initial stage of the aggregation process, the amounts of ionic dispersing agents having opposite polarities are displaced in advance from their balance, this ionic displacement is neutralized e.g. with the ionic surfactant as recited above or a compound having an electrovalence, such as a metal salt, and first-stage mother aggregate is formed and stabilized under a temperature lower than the glass transition temperature, and thereafter, as the second stage, a dispersion liquid of resin particles treated with a dispersing agent whose polarity and amount suffice to compensate for the displacement from the balance is added, and therewith the mother particles are coated, and further the thus coated mother particles are stabilized as required by heating to a higher temperature, but lower than the glass transition temperature of the resin contained in the mother particles or addition particles, and then the particles added at the second stage of aggregate formation are coalesced by heating to a temperature higher than the glass transition temperature as they are attached to the surfaces of the mother aggregate particles. These stepwise operations for aggregation may be executed several times.

In the method of manufacturing the present electrostatic-latent-image-developing toner, a pH change is carried out in the aggregation process to generate aggregation, and thereby particles are formed. Concurrently with the pH change, a flocculant is added for the purpose of stabilizing and expediting aggregation of particles or forming aggregate particles having a narrow particle-size distribution.

The flocculant usable for the above purposes, though not particularly limited, is a metal salt of inorganic acid, considered from the viewpoints of stability of aggregate particles, thermal stability and temporal stability of the flocculant and removal of the flocculant at the time of cleaning. Examples of such a flocculant include metal salts of inorganic adds, such as magnesium chloride, sodium chloride, aluminum sulfate, calcium sulfate, ammonium sulfate, aluminum nitrate, silver nitrate, copper sulfate and sodium carbonate. In exemplary embodiments of the invention, however, flocculants containing aluminum (e.g. polyaluminum chloride, aluminum sulfate, potash alum) are used from the viewpoint of controlling the viscosity of ultimate toner particles at the time of fixing.

The amount of such a flocculant added, though varies depending on the electrovalence number, is small in every case. In the case of a salt of trivalent metal such as aluminum, the addition amount is on the order of 0.5 mass % or below. Where the amount of a flocculant added is concerned, the smaller the better, and therefore it is advantageous to use a compound great in electrovalence.

After performing the aggregation process, it is preferable to carry out an adhesion process. In the adhesion process, resin particles are made to adhere to the surfaces of aggregate particles formed by undergoing the aggregation process, thereby forming a coating layer. By doing so, toner having the so-called core/shell structure which is constructed of a core layer and a coating layer covering the core layer is obtained.

The formation of the coating layer (shell layer) is generally carried out by additional addition of a dispersion liquid of resin particles including amorphous resin particles to the dispersion liquid in which the aggregate particles (core particles) are formed in the aggregation process. By the way, in the case of using an amorphous resin also in addition to a crystalline resin in the aggregation process, the amorphous resin used in the adhesion process may be the same as or different from the amorphous resin in the aggregation process.

In general the adhesion process is carried out in the case of manufacturing toner which has the so-called core/shell structure and contains a crystalline resin for a binder resin as a main constituent, together with a release agent, and its principal purposes consist in control of exposure of the release agent and the crystalline resin contained in the core layer at the toner surface and supplementation to the strength of a core layer alone which is insufficient for the strength required of toner particles.

As a method of controlling viscoelasticity of the present toner, it is preferable to adopt a method of controlling an aluminum content of the toner by adjusting the amount of an aluminum-containing flocculant, such as polyaluminum chloride or aluminum sulfate, used in the aggregation process, or a method of charging an appropriate amount of chelating agent at the end of the aggregation process and capturing aluminum ions as pH adjustment is made at a slow pace by use of an aqueous monosodium fumarate solution, thereby removing the complex salt. Examples of the chelating agent include HIDA (hydroxyethyliminodiacetic acid), HEDTA (hydroxyethylethylenediaminetriacetic acid), HEDP (hydroxyethylidenediphosphonio acid) and HIDS (3-hydroxy-2,2'-iminodisuccinic acid), and acids having polar groups and salts thereof or acids having hydroxyl groups and salts thereof are preferable. In exemplary embodiments of the invention, it is especially preferred to use 3-hydroxy-2,2'-iminodisuccinic acid. 3-Hydroxy-2,2'-imminodisuccinic acid is the so-called chelating agent and has an ability to complex metal ions. Although this material is highly hydrophilic because it has a hydroxyl group in its molecular structure, its chelating power is not as strong as the chelating power of EDTA, and therefore it allows particles to aggregate and coalesce while leaving many ionic cross-links on the inside of the toner, or it allows moderate discharge of aluminum element from the inside of the toner to the outside of the disperse system in the cleaning process. Thus, the distribution of aluminum element forming an ionic cross-link structure is properly controlled, and thereby the ionic cross-link structure is retained to result in the success in controlling viscoelasticity of the present toner and the attainment of low glossiness without adverse effect on the fixability.

In using the chelating agent as recited above, it is advantageous to use an aqueous monosodium fumarase solution in combination. Because monosodium fumarate exhibits weak basicity, the pH adjustment during the aggregation can be made to progress moderately, and thereby not only granulation but also capture of aluminum ions can be controlled. Thus, it becomes possible to control the ionic cross-linking and to provide toner having controlled viscoelasticity.

After the aggregation process or both the aggregation process and the adhesion process are performed, coalescence of aggregate particles is carried out in a fusion process. In the fusion process, the pH of a suspension of aggregate particles is adjusted to a range from 5 to 10 under the same stirring condition as in the aggregation process, thereby arresting the proceeding of aggregation, and the aggregate particles in the suspension are fused and coalesced through the heating to a temperature equal to or higher than the highest one among the melting temperatures of binder resins contained in the aggregate particles or, in the cases where particles of amorphous resins (including shell layer forming resins) are contained, through the heating to a temperature equal to or higher than the glass transition temperature of the amorphous resin particles (the highest one among the glass transition temperatures of amorphous resins in the cases where two or more different kinds of amorphous resins are contained), and thereby formed into toner particles.

As to the heating temperature in the fusion process, there is no problem so long as the heating temperature is equal to or higher than the glass transition temperature of the resin, but for the successful proceeding of fusion and coalescence it is preferable that the heating is carried out at a temperature at least 10° C. higher, preferably at least 15° C. higher, than the glass transition temperature of the resin.

As to the heating time, it is appropriate that the heating continue for a time adequate to complete the coalescence, specifically from 0.2 hour to 10 hours. When the particles are solidified after that by lowering the temperature to below the glass transition temperature of the resin, there may be cases where the shape and surface properties of particles vary depending on the temperature lowering speed. For instance, when the temperature is lowered at a high speed, the particles tend to become spherical and have smooth surfaces. On the other hand, when the temperature is lowered at a mild pace, the particles tend to become irregular in shape and have asperities on their surface. Therefore the temperature is preferably lowered at a speed of at least 0.5° C./min, preferably at least 1.0° C./min.

After conclusion of the aggregation process and the fusion process, toner is obtained as fused particles. The fused particles obtained through fusion (toner), as described hereafter, are required to be cleaned after undergoing a solid-liquid separation process such as filtration.

After the cleaning process, the toner particles relating to every exemplary embodiment of the invention are obtained by undergoing the solid-liquid separation process and a drying process. As to the solid-liquid separation process, there is no particular restriction, but suction filtration, pressure filtration or the like is suitable from the productivity point of view. Further, there is no particular restriction as to the drying process, but freeze drying, flash jet drying, flow drying, vibrating flow drying or the like is preferably adopted from the productivity view point.

The present electrostatic-latent-image-developing toner, as mentioned above, can be manufactured by preparing toner particles (mother particles), adding the inorganic particles as recited above to the toner particles, and then mixing them with a Henschel Mixer or the like.

<Electrostatic Latent Image Developer>

The electrostatic latent image developer according to an exemplary embodiment of the invention has no particular restriction so long as it contains the present electrostatic-latent-image-developing toner, and can adopt an appropriate chemical composition in response to the intended purpose. When the present electrostatic latent image developing toner is used by itself, the electrostatic latent-image developer according to an exemplary embodiment of the invention is prepared as a one-component electrostatic latent-image developer; while, when the present electrostatic latent image developing toner is used in combination with a carrier, the electrostatic latent-image developer is prepared as a two-component electrostatic latent-image developer.

In the case of the two-component system, for example, the carrier used has no particular restriction, and those which in themselves are publicly known can be used. More specifically, known carriers such as the resin-coated carriers disclosed e.g. in JP-A Nos. 62-39879 and 56-11461 are usable.

Examples of such a carrier include the following resin-coated carriers. Specifically, examples of a core particle of the carrier include commonly used iron powder, reconstituted ferrite, reconstituted magnetite and the like, and the volume-average size of core particles is in a range from 30 μm to 200 μm.

Examples of a coating resin for the resin-coated carrier include homopolymers of monomers chosen from styrenes such as styrene, p-chlorostyrene and α-methylstyrene, α-methylene aliphatic carboxylic acids such as methyl acrylate, ethyl acrylate, n-propyl acrylate, lauryl acrylate, 2-ethylhexyl acrylate, methyl methacrylate, n-propyl methacrylate, lauryl methacrylate and 2-ethylhexyl methacrylate, nitrogen-containing acrylates such as dimethylaminoethyl methacrylate, vinyl nitriles such as acrylonitrile and methacrylonitrile, vinylpyridines such 2-vinylpyridine and 4-vinylpyridine, vinyl ethers such as vinyl methyl ether and vinyl isobutyl ether, vinyl ketones such as vinyl methyl ketone, vinyl ethyl ketone and vinyl isopropenyl ketone, polyolefins such as ethylene and propylene, or fluorine-containing vinyl monomers such as vinylidene fluoride, tetrafluoroethylene and hexafluoroethylene, copolymers of two or more kinds of monomers chosen from the above-recited ones, and further include silicone resins such as methylsilicone and methylphenylsilicone, polyesters containing bisphenol, glycol or the like, epoxy resin, polyurethane resin, polyamide resin, cellulose resin, polyether resin and polycarbonate resin.

These resins may be used alone or as combinations of two or more thereof.

Such a coating resin is coated in an amount ranging preferably from 0.1 parts by mass to 10 parts by mass, far preferably from 0.5 parts by mass to 3.0 parts by mass, per 100 parts by mass of the core particles.

For manufacturing the carrier, a heat-applied kneader, a heat-applied Henschel mixer, a UM mixer and so on can be used, and depending on the amount of the resin coated, a heat-applied fluidized tumbling bed, a heat-applied kiln and the like can be used.

In the two-component electrostatic latent-image developer, the mixing ratio (by mass) between the present electrostatic-latent-image-developing toner and the carrier has no particular limitations and can be chosen as appropriate according to the intended purpose. Specifically, it is preferable that the mixing ratio, toner carrier, is in a range of the order of 1:100 to 30:100, preferably in a range of the order of 3:100 to 20:100.

<Image Forming Apparatus>

Next, image forming apparatus incorporating the present electrostatic-latent-image-developing toner is illustrated below.

The image forming apparatus according to an exemplary embodiment of the invention has a latent-image holding member, a development unit in which electrostatic latent images formed on the latent-image holding member are developed as toner images by use of a developer, a transfer unit by which the toner images formed on the latent-image holding member are transferred to a transfer-receiving material, a fixing unit by which the toner images transferred to the transfer-receiving material are fixed, and a cleaning unit in which a cleaning member is made to slide over the surface of the latent-image holding member so that the members' surfaces rub against each other, and thereby ingredients remaining after the transfer are cleaned off the latent-image holding member, and what is more, it uses as the developer the electrostatic latent-image developer according to an exemplary embodiment of the invention. An example of the image forming apparatus according to an exemplary embodiment of the invention is illustrated below, but the invention should not be construed as being limited to this example.

In the image forming apparatus, a section including e.g. the development unit may have a cartridge structure (process cartridge) designed to be attachable to and detachable from the apparatus proper, and the process cartridge is equipped at least with a developer holding member and structured to accommodate the electrostatic latent-image developer according to an exemplary embodiment of the invention.

Figure 2:
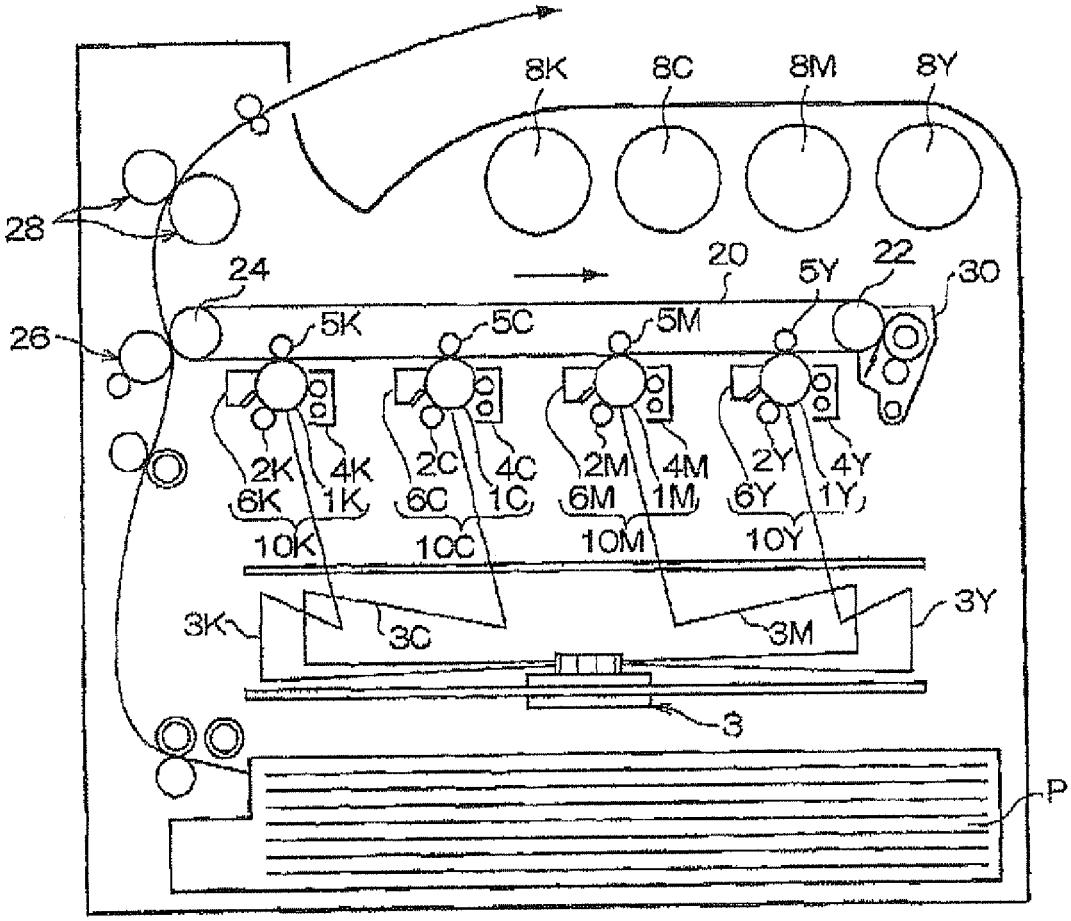
FIG. 2 is a schematic structural diagram showing color-image forming apparatus of four-gang tandem type as one example of exemplary embodiments of the invention.

FIG. 2 is a schematic structural diagram showing 4-gang tandem color image forming apparatus as an example of the image forming apparatus according to an exemplary embodiment of the invention. In the following descriptions, the main part of the apparatus shown in FIG. 2 is explained, and explanation of the other part is omitted. The image forming apparatus shown in FIG. 2 is equipped with first to fourth electrophotographic image forming units 10Y, 10M, 10C and 10K which can produce output in the form of images of various colors, yellow (Y), magenta (M), cyan (C) and black (K), based on image data having undergone color separation. These image forming units (hereafter referred simply to as "units") 10Y, 10M, 10C and 10K are juxtaposed in a horizontal direction at predetermined unit intervals. These units 10Y, 10M, 10C and 10K may be process cartridges attachable to and detachable from the image forming apparatus proper.

At the upper position of each of the units 10Y, 10M, 10C and 10K in FIG. 2, an intermediate transfer belt 20 which functions as an intermediate transfer material shared by all the units is placed. The intermediate transfer belt 20 is looped over a drive roller 22 for forcing the belt to turn round and a support roller 24 placed in contact with the inner surface of the intermediate belt 20, wherein these rollers are placed in the direction from the left to the right in FIG. 2 so as to keep a distance between them, and arranged to run in a direction from the first unit 10Y toward the fourth unit 10K. In addition, impetus is added to the support roller 24 with a spring or the like (not shown in the diagram) in a direction moving away from the drive roller 22, and thereby a predetermined tension is applied to the intermediate belt 20 looped over the both rollers. Further, an intermediate transfer material cleaning apparatus 30 is provided in the position opposing to the drive roller 22 via the intermediate transfer belt 20.

And four colors of toner, namely yellow toner, magenta toner, cyan toner and black toner, held in toner cartridges 8Y, 8M, 8C and 8K, respectively, are fed into developing devices (development units) 4Y, 4M, 4C and 4K of the units 10Y, 10M, 10C and 10K, respectively.

The first to fourth units 10Y, 10M, 10C and 10K have the makeup equivalent to one another, and hence an explanation of the first unit 10Y which is positioned on the upstream side of the running direction of the intermediate transfer belt and has the function of forming yellow images is given below on behalf of these four units. Incidentally, since explanations of the second to fourth units 10M, 10C and 10Y can also be made by giving reference signs (M) of magenta, (C) of cyan and (K) of black to the members corresponding to each member in the first unit 10Y, respectively, in place of (Y) of yellow, individual explanation of each unit is omitted here.

The first unit 10Y has a photoreceptor 1Y which functions as a latent-image holding member. Around the photoreceptor 1Y, a charging roller 2Y with which the surface of the photoreceptor 1Y becomes electrostatically charged so as to have a predetermined electric potential, an exposure unit 3 with which the charged photoreceptor surface is exposed to a laser beam 3Y based on color-separated image signals and forms electrostatic latent images, a developing device (development unit) 4Y with which charged toner is fed to the electrostatic latent images and thereby the electrostatic latent images are developed, a primary transfer roller 5Y (primary transfer unit) with which the developed toner images is transferred to the intermediate transfer belt 20, and a photoreceptor cleaning device (cleaning unit) 6Y with which toner remaining on the surface of the photoreceptor 1Y after the primary transfer is removed are disposed in order of mention.

The primary transfer roller 5Y is placed inside the intermediate transfer belt 20, and installed in a position opposite the photoreceptor 1Y. Further, bias power supply (not shown in the diagram) for applying primary transfer bias is connected to each of the primary transfer rollers 5Y, 5M, 5C and 5K. Each bias power supply renders the transfer bias applied to each primary transfer roller adjustable under the control by a control section not shown in the diagram.

The operation for forming yellow images in the first unit 10Y is explained below. Prior to the operation, the surface of the photoreceptor 1Y is electrostatically charged by means of a charging roller 2Y so as to have an electric potential of the order of −600V to −800V.

The photoreceptor 1Y is formed by laminating a conductive substrate with a photoreceptive layer. The term "conductive" as used herein refers to the state exhibiting conductivity that the volume resistivity measured on the basis of JIS K 7194, Conductive plastic resistivity testing method according to four-point probe method, is lower than $10^7$ Ω·cm. The photoreceptor has high resistance (almost the same level of resistance that general resins have) under normal conditions, but has a property that, when irradiated with a laser beam 3Y, the laser beam-irradiated areas vary their resistivity. Then, the laser beam 3Y is put out on the surface of the charged photoreceptor 1Y via the exposure unit 3 according to image data for yellow which is sent from the control section not shown in the diagram, and thereby electrostatic latent images are formed in an yellow-printed pattern on the surface of the photoreceptor 1Y.

The term "electrostatic latent image" as used herein refers to the image formed on the surface of the photoreceptor 1Y by electrostatic charging, which is the so-called negative image that is formed by lowering the resistivity of irradiated areas of the photoreceptive layer through irradiation with a laser beam 3Y to result in drainage of charges produced by charging of the surface of the photoreceptor 1Y and, on the other hand, by leaving charges on the areas not irradiated with the laser beam 3Y.

The electrostatic latent images thus formed on the photoreceptor 1Y are rotated to a predetermined position for development by following the running of the photoreceptor 1Y. And at this development position, the electrostatic latent images on the photoreceptor 1Y are converted to visual images (toner images) with the development unit 4Y.

The present yellow toner is accommodated in the development unit 4Y. The yellow toner is triboelectrified by undergoing agitation inside the development unit 4Y, and held on a developer roll (developer holding member) in a state of having electric charges of the same polarity (negative polarity) as that of the electric charges produced on the photoreceptor 1Y. By passage of the surface of the photoreceptor 1Y through the development unit 4Y, the yellow toner adheres electrostatically to the electrically-neutralized latent-image areas on the surface of the photoreceptor 1Y. Thus, the latent images are developed by the yellow toner. The photoreceptor 1Y on which the yellow toner image are formed is made to continue running at a predetermined speed, and the toner image developed on the photoreceptor 1Y is conveyed to a predetermined position for the primary transfer.

When the yellow toner images on the photoreceptor 1Y are conveyed to the primary transfer position, a predetermined primary transfer bias is applied to the primary transfer roller 5Y, and electrostatic power heading toward the primary transfer roller 5Y from the photoreceptor 1Y acts on the toner images to result in transfer of the toner images on the photoreceptor 1Y onto the intermediate transfer belt 20. The transfer bias applied at this time is positive in polarity, namely opposite (negative) in polarity to the toner, and controlled to e.g. around +10 μA by a control section (not shown in the diagram) in the first unit 10Y. On the other band, the toner remaining on the photoreceptor 1Y is removed by the cleaning device 6Y and collected.

The primary transfer biases applied to the primary transfer rollers 5M, 5C and 5K of the second unit 10M and thereafter, respectively, are also controlled in conformity with the first unit's case.

The intermediate transfer belt 20 to which the yellow toner images are thus transferred in the first unit 10Y is conveyed while passing through the second to fourth units 10M, 10C and 10K in sequence, and thereon toner images various in color are laid one on top of another. Thus, multiple transfers are performed.

The intermediate transfer belt 20 having undergone multiple transfers of toner images of four colors by passage through the first to fourth units is led to a secondary transfer section which is made up of the intermediate transfer belt 20, a supporting roller 24 kept in contact with the inner surface of the intermediate transfer belt 20 and a secondary transfer roller (secondary transfer unit) 26 disposed on the side of the image holding surface of the intermediate transfer belt 20. On the other hand, by the intermediary of a paper feed mechanism, recording paper (transfer receiving material) P is fed with a predetermined timing into a clearance between the secondary transfer roller 26 and the intermediate transfer belt 20 which are kept in contact with each other in a pressurized condition, and a predetermined secondary transfer bias is applied to the supporting roller 24. The polarity of the transfer bias applied herein is the same (negative) as the polarity (negative) of the toner, and the electrostatic power heading toward the recording paper P from the intermediate transfer belt 20 acts on the toner images, and thereby the toner images on the intermediate transfer belt 20 are transferred to the recording paper P. The secondary transfer bias applied herein is determined in accordance with the resistance detected by means of a resistance detecting unit (not shown in the diagram) which detects resistance of the secondary transfer section, and subjected to voltage control.

Thereafter, the recording paper P is forwarded to a fixing device (fixing unit) 28 and the toner images thereon are heated, and thereby the toner images which are various in color and laid one on top of another are fused and fixed to the recording paper P. The recording paper P having finished fixing of color images is conveyed toward a discharge section. Thus, a series of operations for color-image formation is completed.

Although the image forming apparatus taken as an exemplary example is configured to transfer toner images to recording paper P through the intermediate transfer belt 20, this makeup should not be construed as limiting the scope of the invention, but such makeup as to transfer toner images directly from photoreceptors to recording paper may be adopted.

The image forming apparatus according to an exemplary embodiment of the invention uses the present electrostatic-latent-image-developing toner, and therefore it not only resists impairment of low-temperature fixability, it also delivers images having low glossiness and excellent image reproducibility, as compared with cases where no consideration is given to aluminum contents in the surface and inner portions of toner.

<Process Cartridge and Toner Cartridge>

Figure 3:
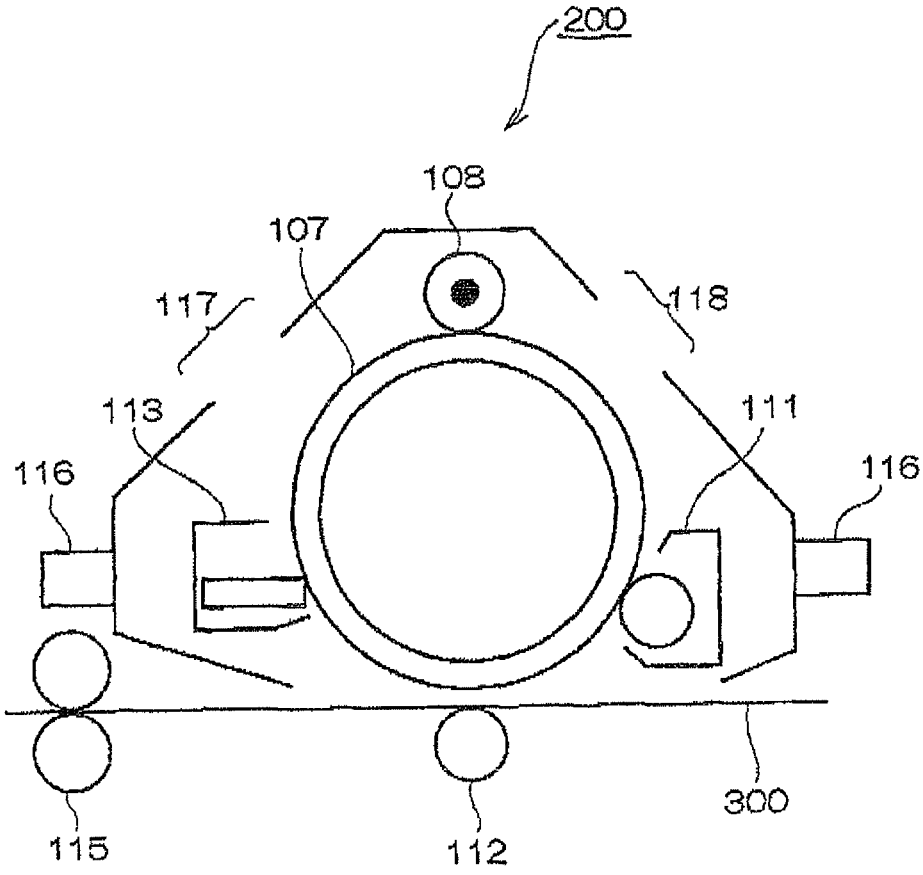

FIG. 3 is a schematic diagram showing a suitable example of a process cartridge which accommodates the electrostatic latent-image developer according to an exemplary embodiment of the invention. The process cartridge 200 has a photoreceptor 107, and moreover a charging roller 108, a developing device 111, a photoreceptor cleaning device (cleaning unit) 113, an opening 118 for exposure and an opening 117 for static-charge neutralization exposure, and these components are combined into one system by use of an installation rail 116. Incidentally, the reference numeral 300 represents a transfer-receiving material.

The process cartridge 200 is designed to be attachable to and detachable from the image forming apparatus proper which includes the transfer device 112, the fixing device 115 and other components not shown in FIG. 2, and makes up the image forming apparatus together with the main body of image forming apparatus.

Although the process cartridge 200 shown in FIG. 3 is provided with a charging roller 108, a developing device 111, a cleaning device (cleaning unit) 113, an opening 118 for exposure and an opening 117 for static-charge neutralization exposure, these components can be selectively combined. The process cartridge 200 according to an embodiment of the invention may be a cartridge provided with a photoreceptor 107 and at least one component selected from a group consisting of a charging roller 108, a developing device 111, a photoreceptor cleaning device (cleaning unit) 113, an opening 118 for exposure and an opening 117 for static-charge neutralization exposure.

Next a toner cartridge according to an exemplary embodiment of the invention is explained. The toner cartridge according to an exemplary embodiment of the invention is a cartridge to be attached to and detached from the image forming apparatus, and accommodates at least toner to be fed into the developing device 111 installed in the image forming apparatus. The toner accommodated in the cartridge is the toner relating to every exemplary embodiment of the invention. Incidentally, to the toner cartridge according to an exemplary embodiment of the invention, it is essential only that at least toner be accommodated therein. Depending on the mechanism of the image forming apparatus, the toner cartridge may accommodate e.g. the electrostatic latent-image developer.

Therefore the use of the toner cartridge accommodating the present toner in the image forming apparatus configured to allow attachment and detachment of the toner cartridge makes it easy to feed the present toner into the developing device.

The image forming apparatus shown in FIG. 2 is image forming apparatus which has a structure allowing attachment and detachment of toner cartridges 8Y, 8M, 8C and 8K, and developing devices 4Y, 4M, 4C and 4K are connected to the toner cartridges corresponding in color to the developing devices, respectively, by toner supply tubes not shown in FIG.

2. In addition, each toner cartridge can be replaced when the toner accommodated therein gets short.

Example

The invention will now be illustrated in detail by reference to the following examples, but these examples should not be construed as limiting the scope of the invention. Additionally, in the following examples, all parts and percentages are by mass unless otherwise indicated.

Any toner used in each of Examples and Comparative Examples is made in the following manner. More specifically, the following dispersion liquids of particulate resins and dispersion liquid of a coloring agent are prepared individually, these dispersion liquids are mixed in a predetermined ratio with stirring, and a flocculant made up of inorganic metal salts including at least aluminum is added to the dispersion mixture in order to accomplish ionic neutralization, whereby aggregate particles are formed. Thereafter, the pH of the disperse system which is weakly acidic is adjusted to be neutral by use of an inorganic hydroxide, and then the aggregate particles are used and coalesced by heating to a temperature equal to or higher than the glass transition temperature of the resin particles. Thereafter, the aggregate particles thus treated are subjected to sufficient cleaning, solid-liquid separation and drying, thereby providing the intended toner.

<Measurement Methods of Various Characteristics>

Methods of physical characteristic measurements made on toner and the like used in Examples and Comparative Examples are explained below, (Method for Measuring Weight-average Molecular Weight of Resin)

The molecular-weight distribution of a resin is determined under the following conditions. More specifically, HC-8120GPC and SC-8020 (made by TOSOH CORPORATION) are used as a GPC system, two columns of TSKgel Super JM-H (6.0 mmID×15 cm, made by TOSOH CORPORATION) are used, and THF (tetrahydrofurn) is used as an eluant. As to experimental conditions adopted, the sample concentration is 0.5%, the flow rate is 0.6 ml/min, the amount of a sample infused is 10 μl, the measurement temperature is 40° C., and experiments are carried out using an IR detector. In addition, a calibration curve is made from 10 polystyrene standard samples produced by TOSOH CORPORATION, TSK Standard: A-500, F-1, F-10, F-80, F-380, F-2500, F-4, F-40, F-128 and F-700.

(Method for Measuring Fusion Temperature and Glass Transition Temperature of Resin)

The fusion temperatures of toner and a crystalline resin, and the glass transition temperatures of toner and an amorphous resin are determined from their individual maximum peaks measured in accordance with ASTMD3418-8. Additionally, each glass transition temperature is defined as the temperature at which the base line in the endothermic portion and extension of the rising line intersect with each other, and the fusion temperature is defined as the temperature at the top of the endothermic peak.

Additionally, a differential scanning calorimeter (DSC-60A with an automatic cooler, made by Shimadzu Corporation) is used for measurements.

(Method for Measuring Volume-Average Diameter of Resin Particles, Coloring Agent Particles, or so on)

The volume-average diameter of resin particles, coloring agent particles or so on is measured with a laser diffraction/scattering particle size analyzer (LS13320, made by Beckman Coulter, Inc.).

(Method for Measuring Aluminum Content)

The aluminum content of the toner surface relating to every exemplary embodiment of the invention is determined from element-specified analysis through the use of an X-ray photoelectron spectroscopic instrument (XPS). More specifically, the sample used is 0.2 g of the toner and the measuring equipment used is an X-ray photoelectron spectroscopic instrument JPS9000MX made by JEOL Ltd. And the aluminum content is determined from the elemental composition ratio.

(Method for Measuring Viscoelastic Characteristic)

The viscoelastic characteristic in the invention is measured with a rheometer (ARES Rheometer, made by Rheometric Scientific, Inc.).

As to the storage modulus, loss modulus and tang δ characteristics, the toner is shaped first into tablets with a molding machine, then a sample tablet is set in a 8-mm-dia parallel plate at a temperature from 120° C. to 140° C., and further cooled to room temperature (25° C.). Thereafter, while the sample is heated at a temperature-rise speed of 1° C./min under a condition of 1 Hz frequency, storage modulus, loss modulus and tango measurements are made at the time of every temperature rise of 2° C. in a range from 30° C. to 180° C. In these measurements, the upper limit of distortion is set at 20%.

On the other hand, relaxation modulus and relaxation time measurements are made in accordance with the frequency dispersion measuring method based on a sine-wave vibration technique. In the same mariner as described above, the toner is shaped into tablets with a molding machine and set in a 25-mm-dia parallel plate. Thereto, after the normal force is adjusted to zero, sine-wave vibrations are applied at vibration frequencies ranging from 0.1 rad/sec to 100 rad/sec. The measurements are initiated at 100° C., and made continuously until the temperature goes up to 160° C. The measurement interval is set at 30 seconds, and the amount of distortion at each temperature during the measurement is adjusted as appropriate every time the measurement is made in order to ensure appropriate measured values, namely values within detection limits of the rheometer used. The relaxation modulus and the relaxation time are determined from measurement results obtained at those various measurement temperatures.

Synthesis of Amorphous Polyester Resin (1)

| | |
|---|---|
| Polyoxypropylene(2,2)-2,2-bis(4-hydroxyphenyl)propane | 80 parts by mole |
| Polyoxyethylene(2,2)-2,2-bis(4-hydroxyphenyl)propane | 20 parts by mole |
| Terephthalic acid | 50 parts by mole |
| Fumaric acid | 25 parts by mole |
| Dodecenyl succinate | 25 parts by mole |
| $Ti(OBu)_4$ | 0.05 parts by mole |

In a three-necked flask having undergone heated-air drying, the foregoing ingredients are placed and then the air in the flask is reduced in pressure by decompression operation and further changed to inert atmosphere by admission of nitrogen gas. Under these conditions, the ingredients are refluxed at 180° C. under mechanical stirring for 5 hours. Thereafter, while the water produced in the reaction system is distilled away by reduced-pressure distillation, the temperature of the reaction system is gradually raised up to 230° C. Further, the dehydration condensation reaction is made to continue at 240° C. for 3 hours. When the reaction system comes to have consistency, the molecular weight is checked by GPC. At the time when the reaction product achieves a weight-average molecular weight of 183,000, reduced-pressure distillation is stopped. Thus, an amorphous polyester resin (1) to be used as a binder resin is obtained. This amorphous polyester resin (1) is in a noncrystalline state, and has a glass transition temperature of 61° C., a softening temperature of 110° C. and an acid value of 13.4 mg/KOH. Incidentally, the abbreviation "Bu" used in the invention stands for a butyl group.

Synthesis of Amorphous Polyester Resin (2)

| | |
|---|---|
| Polyoxypropylene(2,2)-2,2-bis(4-hydroxyphenyl)propane | 80 parts by mole |
| Polyoxyethylene(2,0)-2,2-bis(4-hydroxyphenyl)propane | 20 parts by mole |
| Terephthalic acid | 50 parts by mole |
| Dodecenyl succinate | 40 parts by mole |
| 1,2,4-benzenetricarboxylic acid (trimellitic acid) | 10 parts by mole |
| $Ti(OBu)_4$ | 0.05 parts by mole |

An amorphous polyester resin (2) to be used as a binder resin is synthesized in the same manner as the amorphous polyester resin (1), except that the ingredients described above are used as raw materials for the synthesis.

When molecular weight measurement is made by the same method as in the case of the amorphous polyester resin (1), the weight-average molecular weight (Mw) of the amorphous polyester resin (2) is found to be 34,600. In addition, the acid value of the amorphous polyester resin (2) is found to be 17.1 mg/KOH.

By carrying out melting temperature measurement on the amorphous polyester resin (2) in the same manner as in the case of the amorphous polyester resin (1), a DSC spectrum is obtained. The DSC spectrum obtained shows no clear peak, but a step change in quantity of heat absorbed is observed therein. When the midpoint of a step change in quantity of heat absorbed is taken as a glass transition temperature (Tg), the glass transition temperature of the amorphous polyester resin (2) is found to be 61° C.

(Synthesis of Crystalline Polyester Resin)

In a three-necked flask having undergone heated-air drying, 43.4 parts by mass of 1,10-dodecene dicarboxylic acid, 32.8 parts by mass of 1,9-nonanediol, 27 parts by mass of dimethylsulfoxide and 0.03 parts by mass of dibutyltin oxide as a catalyst are placed, and then the air in the flask is changed to inert atmosphere of nitrogen gas with the aid of decompression operation. Under these conditions, the ingredients are mixed at 180° C. under mechanical stirring for 4 hours. The dimethyl sulfoxide is distilled away under reduced pressure. Thereafter, the temperature of the reaction system is gradually raised up to 220° C. under reduced pressure, and the stirring is made to continue for 1.5 hour. When the reaction system comes to have consistency, the reaction is stopped by air cooling. Thus, a crystalline polyester resin to be used as a binder resin is synthesized.

When molecular weight measurement is made by the same method as in the case of the amorphous polyester resin (1), the weight-average molecular weight (Mw) of the crystalline aliphatic polyester resin obtained is found to be 24,000.

By carrying out melting temperature measurement on the crystalline aliphatic polyester resin in the same manner as in the case of the amorphous polyester resin (1), a DSC spectrum is obtained. The DSC spectrum obtained shows a clear peak, and this peak indicates that the melting temperature (Tm1) of the crystalline polyester resin is 79° C.

<Preparation of Dispersion Liquid of Particulate Resin>

(Dispersion Liquid of Particulate Amorphous Polyester Resin (1))

Into a 5 L separable flask equipped with an anchor blade for providing stirring power, a reflux condenser and a decompression unit using a vacuum pump, 175 parts of methyl ethyl ketone and 70 parts of isopropanol are charged, and then mixed. Into this solvent mixture, 350 parts of the amorphous polyester resin (1) is gradually charged, and heated to 40° C. while stirring with a three-one motor agitator, thereby forming an oil phase in a state of complete dissolution. Into the oil phase under stirring, 9.6 parts of 10% aqueous solution of $NH_4OH$ is dripped, and subsequently thereto ion exchange water is dripped, thereby causing phase-inversion emulsification. And removal of the solvents is performed under decompression by means of an evaporator. Thus, a dispersion liquid of particulate amorphous polyester resin (1) is obtained. The volume-average particle size of resin particles in the dispersion liquid of particulate amorphous polyester resin (1) is found to be 165 nm. In addition, the particulate resin concentration is adjusted to 30% by addition of ion exchange water.

(Dispersion Liquid of Particulate Amorphous Polyester Resin (2))

A dispersion liquid of particulate amorphous polyester resin (2) is prepared similarly to the dispersion liquid of particulate amorphous polyester resin (1). The volume-average particle size of resin particles in the dispersion liquid of particulate amorphous polyester resin (2) is found to be 162 nm. In addition, as in the case of the dispersion liquid of particulate amorphous polyester resin (1), the particulate resin concentration is adjusted to 30% by addition of ion exchange water.

(Dispersion Liquid of Particulate Crystalline Polyester Resin)

Into a 5 L separable flask equipped with a stirrer and a thermometer, 180 parts of methyl ethyl ketone and 45 parts of isopropanol are charged, and then mixed. Into this solvent mixture, 300 parts of the crystalline polyester resin is gradually charged, and heated to 70° C. while stirring with a three-one motor agitator, thereby forming an oil phase in a state of complete dissolution. Into the oil phase under stirring, 14 parts of a 10% aqueous solution of $NH_4OH$ is dripped, and subsequently thereto ion exchange water is added dropwise, thereby causing phase-inversion emulsification. And removal of the solvents is performed under decompression by means of an evaporator. Thus, a dispersion liquid of particulate crystalline polyester resin is obtained.

The volume-average particle size of resin particles in the dispersion liquid of particulate crystalline polyester resin is found to be 173 nm. In addition, the particulate resin concentration is adjusted to 25% by addition of ion exchange water.

(Preparation of Dispersion Liquid of Particulate Styrene-Butyl Acrylate Resin (1))

| | |
|---|---|
| Styrene | 370 parts |
| n-Butyl acrylate | 30 parts |
| Acrylic acid | 4 parts |
| Dodecane thiol | 24 parts |
| Carbon tetrabromide | 4 parts |

In a flask, 6 parts of a nonionic surfactant (NONIPOL 400, manufactured by Sanyo Chemical Industries, Ltd.) and 10 parts of anionic surfactant (NEOGEN SC, manufactured by DAI-ICHI KOGYOU SEIYAKU CO., LTD.) are dissolved in 560 parts of ion exchange water, and in this surfactant solution the foregoing ingredients mixed together and made into a solution are dispersed and emulsified. While the emulsion obtained is stirred for 10 minutes with a slow space, 50 parts of ion exchange water in which 4 parts of ammonium persulfate is dissolved is charged into the emulsion under stirring. After the air in the flack is replaced with nitrogen, the flask is heated in an oil bath till the contents becomes 70° C. under stirring, and without changing these conditions, emulsion polymerization is made to continue for 5 hours. Thus, a dispersion liquid of particulate styrene-butyl acrylate resin (1) (particulate resin concentration: 40 mass %) is prepared. Herein, it is found that the dispersed resin particles have an average particle diameter of 165 nm, a glass transition temperature of 58° C. and a weight-average molecular weight (Mw) of 14,400.

(Preparation of Dispersion Liquid of Particulate Styrene-Butyl Acrylate Resin (2))

| | |
|---|---|
| Styrene | 280 parts |
| n-Butyl acrylate | 120 parts |
| Acrylic acid | 8 parts |

In a flask, 6 parts of a nonionic surfactant (NONIPOL 400) and 12 parts of anionic surfactant (NEOGEN SC) are dissolved in 550 parts of ion exchange water, and in this surfactant solution the foregoing ingredients mixed together and made into a solution are emulsified by 10-minute dispersion processing. While the emulsion obtained is stirred with a slow space, 50 parts of ion exchange water in which 3 parts of ammonium persulfate is dissolved is charged into the emulsion under stirring, and the air in the flack is replaced with nitrogen. Thereafter, the flask is heated in an oil bath till the contents becomes 70° C. under stirring, and without changing these conditions, emulsion polymerization is made to continue for 5 hours. Thus, a dispersion liquid of particulate styrene-butyl acrylate resin (2) (particulate resin concentration: 40 mass %) is prepared. Herein, it is found that the dispersed resin particles have a median diameter of 118 nm, a glass transition temperature of 54° C. and a weight-average molecular weight (Mw) of 550,000.

Preparation of Dispersion Liquid of Particulate Coloring Agent

| | |
|---|---|
| Black pigment (NIPex35, manufactured by DEGUSSA AG) | 36.0 parts |
| Ionic surfactant (Neogen RK, manufactured by DAI-ICHI KOGYO SEIYAKU CO., LTD.) | 4.0 parts |
| Ion exchange water | 160 parts |

The foregoing ingredients are mixed together and made into a solution, and further subjected to dispersion processing for about 1 hour by use of a high-pressure impact dispersing machine ULTIMIZER (HJP30006, made by SUGINO MACHINE LIMITED). Thus, a dispersion liquid of particulate coloring agent having a median particle diameter of 168 nm and a solid content of 20% is obtained.

Preparation of Dispersion Liquid of Particulate Release Agent

| | |
|---|---|
| Paraffin Wax (FNP 92, manufactured by NIPPON SEIRO CO., LTD.) | 50 parts |
| Anionic surfactant (Neogen RK, manufactured by DAI-ICHI KOGYO SEIYAKU CO., LTD.) | 0.5 parts |
| Ion exchange water | 200 parts |

The foregoing ingredients are mixed together, heated to 95° C., and then dispersed with a homogenizer (ULTRA-TURRAX T50, an IKA product). Thereafter, dispersion processing is further performed with a Manton-Gaulin high-pressure homogenizer (made by Gaulin Corporation). By dispersing the release agent in this manner, a dispersion liquid of particulate release agent (solid concentration: 30%) is prepared. The volume-average particle diameter of the particulate release agent is found to be 183 μm.

Making of Mother Particles of Toner 1:

| | |
|---|---|
| Dispersion liquid of particulate amorphous polyester resin (1) | 140 parts |
| Dispersion liquid of particulate amorphous polyester resin (2) | 140 parts |
| Dispersion liquid of particulate coloring agent | 51 parts |
| Dispersion liquid of particulate release agent | 50 parts |
| Anionic surfactant (20% solution of TaycaPower BN2060, manufactured by Tayca Corporation) | 14 parts |
| Ion exchange water | 300 parts |

The foregoing ingredients are placed in a stainless vessel, and thereto a 0.3 mol/l aqueous solution of nitric acid is admixed while shear stress is applied thereto at 1,000 rpm by means of ULTRA-TURRAX (an IKA product) until the pH of the dispersion mixture reaches 4.8. Thereafter, 85 parts of a 10% aqueous solution of aluminum sulfate as a flocculant is dripped into the dispersion mixture. Since the mixture of the ingredients increases in viscosity during the dripping of the flocculent, the dripping speed is reduced at the time when the viscosity begins to increase, and thereby care is taken not to distribute the flocculant unevenly. After the dripping of the flocculant is completed, the stirring is made to continue for additional 15 minutes under a condition that the number of revolutions is increased to 6,000 rpm, and thereby the flocculent and the mixture of the ingredients are thoroughly blended together.

Next the mixture of the ingredients is transferred to a polymerization pot equipped with a pH meter, an agitation blade and a thermometer. While the mixture is stirred at a rotation speed in a range of 550 rpm to 650 rpm, the temperature thereof is increased from room temperature to 40° C. over 2 hours by means of a mantle heater. During the temperature rise, the aggregate particles are made to grow while whether or not primary particles are formed with stability is checked by use of MULTISIZER II (aperture diameter: 50 μm, a product of Beckman Coulter, Inc.). Herein, it is preferable that the growth of aggregate particles is checked by use of MULTISIZER II whenever necessary. The aggregation temperature and the number of revolutions for stirring are changed according to the aggregation speed. Further, the temperature of aggregate particles is raised to 49° C. from 40° C. over 110 minutes while varying the aggregation temperature and the number of revolutions for stirring.

For forming a coating over the aggregate particles, on the other hand, a dispersion liquid of particulate resins for coating use is prepared by mixing 75 parts of the dispersion liquid of particulate amorphous polyester resin (1), 75 parts of the dispersion liquid of particulate amorphous polyester resin (2), 2 parts of an anionic surfactant (20% aqueous solution of TaycaPower BN2060, manufactured by Tayca Corporation) and 35 parts of ion exchange water, and adjusted in advance to pH 2.7. When the aggregate particles grow to a size of 5.4 μm in the aggregation process step, the dispersion liquid of particulate resins for coating use is added thereto, and kept for 10 minutes with stirring. Thereto, 14 parts of a 12% aqueous solution of 3-hydroxy-2,2'-iminodisuccinic acid and 5 parts of a 10% aqueous solution of monosodium fumarate are further added. Thereafter, for the purpose of stopping growth of the coated aggregate particles (accretion particles), a 1M (mol/l) aqueous solution of sodium hydroxide is added, and the mixture as raw material is adjusted to pH 8.0, and allowed to stand for 10 minutes. Then, for the purpose of fusing the aggregate particles, the temperature of the mixture is raised to 92° C. at a temperature rise speed of 1° C./min as the pH is adjusted to 8.0. During the temperature rise, fusion of the particles is pursued while the average roundness of aggregate particles is checked with FPIA-2100 made by Sysmex Corporation whenever necessary, and at the same time, a 1M aqueous solution of sodium hydroxide is added in appropriate amounts at the points of 55° C., 60° C. and 70° C. under temperature rise for the purpose of stopping particle growth. At the time when the average roundness of aggregate particles reaches within a range from 0.960 to 0.970, quenching is carried out at a temperature drop speed of 1.0° C./min by charging ice-cold water.

Thereafter, the raw dispersion liquid is screened with a sieve 20 μm mesh in pore diameter, and thereby filtered. The toner-dispersed liquid after such solid-liquid separation is subjected to suction filtration, and thereby the toner and the dispersing medium undergo solid-liquid separation. Thereafter, to begin with, the toner separated is dispersed into 30° C. ion exchange water the amount of which is 20 times as much as that of the solid component and stirred with a mechanical stirrer. When the solid toner component which is hardened by suction filtration into cake is homogeneously dispersed into the ion exchange water, solid-liquid separation is carried out again by suction filtration. This filtration procedure is carried out again and again. And the conductivity of the filtrate obtained is ascertained to be 19 μS.

At the conclusion of a cleaning process, drying with a vacuum freeze dryer is performed. Thus, mother particles of toner 1 are obtained. The volume-average particle size of the thus obtained mother particles of toner 1 is found to be 5.8 μm. And the average roundness of these mother particles is found to be 0.962.

Making of Mother Particles of Toner 2:

Mother particles of toner 2 are made in the same manner as the mother particles of toner 1, except that, as to the ingredients used in the initial aggregation process for making the mother particles of toner 1, the amount of the dispersion liquid of particulate amorphous polyester resin (1) is changed to 200 parts, the amount of the dispersion liquid of particulate amorphous polyester resin (2) is changed to 80 parts and the amount of the 10% aqueous solution of aluminum sulfate as a flocculant is changed to 100 parts. The volume-average particle size of the thus obtained mother particles of toner 2 is found to be 5.9 μm. And the average roundness of these mother particles is found to be 0.956.

Making of Mother Particles of Toner 3:

Mother particles of toner 3 are made in the same manner as the mother particles of toner 1, except that, as to the ingredients used in the initial aggregation process for making the mother particles of toner 1, the amount of the dispersion liquid of particulate amorphous polyester resin (1) is changed to 120 parts, the amount of the dispersion liquid of particulate amorphous polyester resin (2) is changed to 120 parts and the dispersion liquid of particulate crystalline polyester resin is further added in an amount of 40 parts. The volume-average particle size of the thus obtained mother particles of toner 3 is found to be 5.6 μm. And the average roundness of these mother particles is found to be 0.968.

Making of Mother Particles of Toner 4:

Mother particles of toner 4 are made in the same manner as the mother particles of toner 1, except that, as to the ingredients used in the initial aggregation process for making the mother particles of toner 1, the dispersion liquid of particulate amorphous polyester resin (2) is not used, but the amount of the dispersion liquid of particulate amorphous polyester resin (1) is changed to 280 parts, and further, in the process of forming a coating over the aggregate particles, only the dispersion liquid of particulate amorphous polyester resin (1) is used in an amount of 150 parts. The volume-average particle size of the thus obtained mother particles of toner 4 is found to be 5.4 μm. And the average roundness of these mother particles is found to be 0.969.

Making of Mother Particles of Toner 5:

Mother particles of toner 5 are made in the same manner as the mother particles of toner 1, except that the chelating agent added in the process of forming a coating over the aggregate particles is not monosodium fumarate, but a 10% aqueous solution of EDTA (ethylenediaminetetraacetic acid) sodium salt. The volume-average particle size of the thus obtained mother particles of toner 5 is found to be 5.7 μm. And the average roundness of these mother particles is found to be 0.966.

Making of Mother Particles of Toner 6:

Mother particles of toner 6 are made in the same manner as the mother particles of toner 1, except that, as to the ingredients used in the initial aggregation process for making the mother particles of toner 1, the dispersion liquid of particulate amorphous polyester resin (1) is not used, but the amount of the dispersion liquid of particulate amorphous polyester resin (2) is changed to 280 parts and the flocculant is changed to a 10% aqueous solution of polyaluminum chloride, and besides, in the process of forming a coating over the aggregate particles, only the dispersion liquid of particulate amorphous polyester resin (2) is used in an amount of 150 parts. The volume-average particle size of the thus obtained mother particles of toner 6 is found to be 6.3 μm. And the average roundness of these mother particles is found to be 0.954.

Making of Mother Particles of Toner 7:

| | |
|---|---|
| Dispersion liquid of particulate styrene-butyl acrylate resin (1) | 158 parts |
| Dispersion liquid of particulate styrene-butyl acrylate resin (2) | 105 parts |
| Dispersion liquid of particulate coloring agent | 59 parts |
| Dispersion liquid of particulate release agent | 40 parts |
| Cationic surfactant (SANIZOL B50) | 2.0 parts |

The foregoing ingredients are placed in a stainless cylindrical vessel, and mixed together by undergoing 10-minute dispersion while shear stress is applied thereto at 4,000 rpm by use of a homogenizer ULTRA-TURRAX T50 (an IRA product). Then, addition of a 0.3 mol/l aqueous solution of nitric acid is continued until the pH of the dispersion mixture reaches 4.8. Thereafter, 13 parts of a 10% aqueous solution of aluminum sulfate as a flocculant is dripped into the dispersion mixture, and mixed through 5-minute dispersion under a condition that the number of revolutions of the homogenizer is increased to 5,000 rpm. Thus, the dispersion as raw material is prepared.

Thereafter, the dispersion as raw material is transferred to a stainless polymerization pot equipped with a stirrer and a thermometer, and undergoes stirring and heating up to 54° C. by means of a mantle heater. Thus, growth of the aggregate particles is accelerated. Therein, the pH of the dispersion as raw material is adjusted to a range from 3.8 to 4.2 by use of a 0.3 mol/l aqueous solution of nitric acid and a 1 mol/l aqueous solution of sodium hydroxide. After the resulting dispersion is kept at 54° C. for 1 hour, the average particle diameter thereof is measured with a Coulter counter MULTISIZER II (a product of Beckman Coulter, Inc.). As a result, it is found that aggregate particles 4.9 μm in average particle size are formed. When the dispersion is further kept for 1 hour at a higher temperature of 55° C., the average particle size of the aggregate particles reaches to 5.3 μm.

To the dispersion liquid containing these aggregate particles, 82 parts of the dispersion liquid of styrene-butyl acrylate resin particles (1) is added gently, and allowed to stand for 1 hour in an oil bath the temperature of which is further raised to 56° C. When the average particle diameter measurement is made on the accretion particles obtained, the average particle diameter is found to be 5.5 μm. After 3 parts of an anionic surfactant (NEOGEN SC, manufactured by DAI-ICHI KOGYOU SEIYAKU CO., LTD.) is further added to the dispersion of the accretion particles, the stainless pot is hermetically sealed. Then, while stirring is continued by use of magnetic force seal, the resulting dispersion is heated up to 97° C. and allowed to stand for 4 hours. By doing so, the aggregate particles are fused and, after the fusion of the aggregate particles is ascertained with an optical microscope, cooling is carried out at a temperature drop speed of 10° C./min, followed by cleaning and drying as in the case of the mother particles of toner 1. Thus, mother particles of toner 7 are obtained. The volume-average particle size of the thus obtained mother particles of toner 7 is found to be 5.6 μm. And the average roundness of these mother particles is found to be 0.967.

To each of the mother particles of toner 1 to the mother particles of toner 7, silica fine powder (particle diameter: 50 nm) and titania fine powder (particle diameter: 40 nm) are added as external additives in amounts of 0.9 parts and 0.6 parts, respectively, per 100 parts of mother particles of each toner, and mixed together. Thus, each of toner 1 to toner 7 is obtained. Characteristics of each toner are shown in Table 1.

As shown in Table 1, in one case where the toner 1 is used, the value of G(t1) is 88 and the value of (G(t2)−G(t1))/(log(t1)−log(t2)) (hereinafter referred to as "the range of relaxation modulus") is 540. In another case where the toner 2 is used, the value of G(t1) is 99 and the range of relaxation modulus is 1,229. In still another case where the toner 3 is used, the value of G(t1) is 90 and the range of relaxation modulus is 655. Hence, the value of G(t1) and the range of the relaxation modulus in each of the cases where the toner 1 to the toner 3 are used, respectively, satisfy the requirements expressed by the relations (1) and (2), respectively. By contrast, the range of the relaxation modulus in each of the cases where the toner 4 to the toner 7 are used, respectively, does not satisfy the requirement expressed by the relation (2), and the value of G(t1) in the case where the toner 6 is used does not satisfy the requirement expressed by the relation (1).

On the other hand, the value of tang δ in a temperature range from 80° C. to 140° C. is from 1.15 to 1.35 in the case of using the toner 1, from 1.10 to 1.23 in the case of using the toner 2, and from 1.22 to 1.40 in the case of using the toner 3. Thus, these values are in the range specified by the invention, or in the range from 1.10 to 1.40. By contrast, in the cases of using the toner 4 to the toner 7, respectively, either their individual upper values, or their individual lower values, or the both are out of the specified range.

<<Preparation and Evaluation of Electrostatic Latent-Image Developer>>

<Preparation of Carrier>

| | |
|---|---|
| Ferrite particles (volume-average particle diameter: 35 μm, GSDv: 1.20) | 100 parts |
| Toluene | 14 parts |
| Methyl methacrylate-perfluorooctylethyl acrylate copolymer (copolymerization ratio: 8/2, Mw = 78,000, critical surface tension: $24 \times 10^{-3}$ N/m) | 1.6 parts |
| Carbon black (trade name: VXC-72, a product of Cabot Corporation, volume resistivity: 100 Ωcm or lower) | 0.12 parts |
| Cross-linked melamine resin particles (average particle diameter: 0.3 μm, insoluble in toluene) | 0.3 parts |

Of the above ingredients, carbon black is diluted with toluene before anything else, and added to the methyl methacrylate-perfluorooctylethyl acrylate copolymer, and further subjected to dispersion treatment using a sand mill. Then, the remainder of the ingredients, other than the ferrite particles, is added to the resulting dispersion and dispersed for 10 minutes with a stirrer, thereby preparing a solution for forming a coating layer. Next, the solution thus prepared for forming a coating layer and the ferrite particles are placed in a vacuum degas kneader, and stirred for 30 minutes at a temperature of

TABLE 1

| Toner | Binder Resin | Particle Diameter (μm) | Particle Average roundness | Al Content of Toner Surface (atomic %) | Viscoelasticity Tangδ (80° C.-140° C.) | Viscoelasticity G(t1) | Viscoelasticity G(t2) − G(t1)/log(t1) − log(t2) |
|---|---|---|---|---|---|---|---|
| 1 | Amorphous polyester (1), (2) | 5.8 | 0.962 | 1.8 | 1.15-1.35 | 88 | 540 |
| 2 | Amorphous polyester (1), (2) | 5.9 | 0.956 | 2.0 | 1.10-1.23 | 99 | 1,229 |
| 3 | Amorphous polyester (1), (2) + Crystalline polyester | 5.6 | 0.968 | 1.6 | 1.22-1.40 | 90 | 655 |
| 4 | Amorphous polyester (1) | 5.4 | 0.969 | 0.2 | 1.32-1.68 | 68 | 514 |
| 5 | Amorphous polyester (1), (2) | 5.7 | 0.966 | 0.8 | 1.60-3.30 | 25 | 53 |
| 6 | Amorphous polyester (2) | 6.3 | 0.954 | 4.2 | 1.08-0.65 | 865 | 1,574 |
| 7 | Styrene-acrylic resin | 5.6 | 0.967 | 0.9 | 1.33-0.88 | 20 | 42.6 |

60° C. Thereafter, the toluene is distilled away under reduced pressure. Thus, a resin coating is formed on the ferrite particles to yield a carrier. The volume-average grain size distribution index GSDv of this carrier is found to be 1.20.

<Preparation of Electrostatic Latent-Image Developer>

In a 2-liter V-blender, 36 parts of each toner obtained above and 414 parts of the carrier are placed, stirred for 20 minutes, and further screened with a 212-μm sieve. Thus, electrostatic latent-image developers are prepared.

<<Evaluation of Electrostatic Latent-Image Developer>>

Unfixed images (monochromatic solid images 5 centimeters square in size, toner content: 0.45 g/cm$^2$) are formed by using each of the electrostatic latent-image developers obtained above and an imago forming apparatus DocuCentre 9000 made by Fuji Xerox Co., Ltd. As recording materials, Premire 80 made by Fuji Xerox Co., Ltd. are used. Then, fixing of the unfixed images is carried out with a fixing machine 1 obtained by making adaptations on the fixing machine DocuPrint 02220 made by Fiji Xerox Co., Ltd. to be adjustable for fixing temperature while the fixing temperature is raised stepwise from 100° C. in 5° C. intervals, and thereby the minimum fixing temperature is evaluated. In addition, glossiness and unevenness in gloss of fixed images obtained in the case of setting the fixing temperature at 180° C. are evaluated. Results obtained are shown in Table 2.

Further, image fixing is carried out using the following fixing machine 2 as an off-line fixing machine, not to mention the electrostatic latent-image developers obtained above.

Fixing Machine 2: The heating roll of the Teflon (trade mark) hard-roll fixing machine (2-roll fixing machine) in the fixing unit of DocuCentre f1100GA is modified to have on the substrate (aluminum substrate) a 200 μm-thick elastic layer of silicone rubber with a rubber hardness of 60 and further have a surface layer made up of a 30 μm-thick Teflon (trade mark) tube.

In carrying out image fixing, the fixing machine is operated at two different process speeds (image fixing speeds), 80 mm/sec and 400 mm/sec.

(Method for Fixing Temperature Measurement)

Each of the fixed images thus obtained is valley-folded, the extent to which the image on the folded area exfoliates is observed, and the width of paper exposed at the folded area as a result of exfoliation of the image is measured. The fixing temperature at which the width thus measured reaches 0.5 mm or below is defined as MFT (minimum fixing temperature, ° C.). It can be said that the lower the MFT, the better the low-temperature fixability. The tolerance of MFT is 130° C. or below.

(Method for Glossiness Measurement)

Glossiness at an incident angle of 75 degrees which incident light forms with each of the fixed images is determined by use of a Gloss Meter GM-26D (made by MURAKAMI COLOR RESEARCH LABORATORY CO., LTD.). A permissible range thereof is 25% or less.

<Rating of Unevenness in Gloss>

Unevenness in gloss of each of the fixed images is rated by visual observation according to the following criteria.

A: The proportion of smoothed areas is small, and glossiness is low and gloss is free of unevenness.

B: Smooth areas less than 0.5 mm in size and low-gloss areas are present in a mixed state, but unevenness in gloss is limited.

C: Smooth areas from 0.5 mm or greater and smaller than 1.5 mm in size and low-gloss areas are present in a mixed state, and somewhat uneven gloss is seen in images.

D: Smooth areas 1.5 mm or greater in size and low-gloss areas are present in a mixed state, and uneven gloss is seen in images.

TABLE 2

| | | | Minimum Fixing Temperature (° C.) | | Gloss Characteristics | | | | |
|---|---|---|---|---|---|---|---|---|---|
| | | Fixing | | | Glossiness | | Unevenness in Gloss | | |
| | Toner | Machine | 80 mm/sec | 400 mm/sec | 80 mm/sec | 400 mm/sec | 80 mm/sec | 400 mm/sec | Evaluation |
| Example 1 | 1 | 1 | 110 | 120 | 18 | 11 | B | B | B |
| | | 2 | 110 | 120 | 16 | 13 | B | B | |
| Example 2 | 2 | 1 | 110 | 120 | 17 | 10 | A | A | B |
| | | 2 | 110 | 120 | 14 | 8 | B | B | |
| Example 3 | 3 | 1 | 110 | 110 | 23 | 17 | A | A | A |
| | | 2 | 110 | 110 | 20 | 15 | A | A | |
| Comparative | 4 | 1 | 110 | 110 | 30 | 24 | C | B | D |
| Example 1 | | 2 | 110 | 110 | 27 | 21 | C | B | |
| Comparative | 5 | 1 | 110 | 110 | 82 | 63 | D | C | D |
| Example 2 | | 2 | 110 | 110 | 74 | 56 | D | C | |
| Comparative | 6 | 1 | 145 | 155 | 9 | 7 | C | C | D |
| Example 3 | | 2 | 150 | 160 | 6 | 4 | C | C | |
| Comparative | 7 | 1 | 140 | 150 | 58 | 43 | D | C | D |
| Example 4 | | 2 | 130 | 140 | 51 | 38 | D | C | |

In Table 2, the electrostatic latent-image developers incorporating the toner 1 to 3 shown in Table 1, respectively, are designated as Examples 1 to 3, respectively, and the electrostatic latent-image developers incorporating the toner 4 to 7 shown in Table 1, respectively, are designated as Comparative Examples 1 to 4, respectively.

As shown in Table 2, the electrostatic latent-image developers of Examples 1 to 3 are lower than 130° C. in the minimum fixing temperature whether the fixing machine used is the fixing machine 1 or the fixing machine 2. In addition, whether the image fixing speed is 80 mm/sec or 400 mm/sec, these developers achieve glossiness of 25% or lower and unevenness in the gloss they develop is rated A or B.

As to the electrostatic latent-image developers of Comparative Examples 1 to 4, on the other hand, the minimum fixing temperatures in Comparative Examples 3 and 4 are higher than 130° C. (with the exception of the case where the fixing is performed using the fixing machine 2 at the image fixing speed of 80 mm/sec in Comparative Example 4). And the glossiness is higher than 25% in the case where the image fixing speed is 80 mm/sec in Comparative Example 1 as well as in all the cases of Comparative Examples 2 and 4. Further, the unevenness in gloss is rated B only in the case where the image fixing speed is 400 mm/sec in Comparative Example 1, but rated C or D in the other cases.

As mentioned above, each Example proves that the minimum fixing temperature is controlled to a lower value (in other words, the low-temperature fixability is better) as compared with each Comparative Example, and what is more, each Example proves that not only glossiness but also unevenness in gloss is reduced, irrespective of the process speed.

What is claimed is:

1. An electrostatic latent image developing toner comprising:

a mother particle that contains a coloring agent, a release agent and a binder resin and an inorganic particle that is added to the surface of the mother particle, wherein:

a relation between a relaxation time t and a relaxation modulus G(t) that are determined from the dynamic viscoelasticity measurement made on the toner satisfies the following equations (1) and (2);

$$G(t1)<100 \text{ Pa} \quad (1)$$

$$515<(G(t2)-G(t1))/(\log(t1)-\log(t2))<1{,}230 \quad (2)$$

and t1 represents the maximum relaxation time and t2 represents the minimum relaxation time, the relaxation time t and relaxation modulus G(t) are determined with a sine-wave vibration technique with measurements initiated at a temperature of 100° C. and being made continuously up to 160° C. while sine-wave vibrations are applied at vibration frequency ranging from 0.1 rad/sec to 100 rad/sec, and the toner being contacted with a carrier having a cross-linked melamine resin particle.

2. The electrostatic latent image developing toner as claimed in claim 1, wherein a value of loss tangent tan δ at temperature from about 80° C. to about 140° C. is in a range from about 1.10 to about 1.40.

3. The electrostatic latent image developing toner as claimed in claim 1, wherein the binder resin comprises a crystalline polyester resin and Al element is detected in an amount of about 2.0 atomic % or below when the mother particle is subjected to 10-second argon etching by means of photoelectron spectroscopic apparatus.

4. The electrostatic latent image developing toner as claimed in claim 1, wherein the binder resin comprises a crystalline polyester resin.

5. The electrostatic latent image developing toner as claimed in claim 4, wherein one of polymerizable monomer elements constituting the crystalline polyester resin has a straight-chain aliphatic component.

6. The electrostatic latent image developing toner as claimed in claim 4, wherein the crystalline polyester resin has a melting temperature in a range from about 50° C. to about 100° C.

7. The electrostatic latent image developing toner as claimed in claim 4, wherein the crystalline polyester resin has an acid value (quantity of KOH required for neutralization of 1 g of the resin, expressed in mg) in a range from about 3.0 mg KOH/g to about 30.0 mg KOH/g.

8. The electrostatic latent image developing toner as claimed in claim 4, wherein the crystalline polyester resin has a weight-average molecular weight (Mw) in a range from about 6,000 to about 35,000.

9. The electrostatic latent image developing toner as claimed in claim 4, wherein the crystalline polyester resin is contained in an amount of about 3 mass % to about 40 mass % with respect to the toner.

10. The electrostatic latent image developing toner as claimed in claim 1, wherein the release agent has a melting temperature in a range from about 50° C. to about 100° C.

11. The electrostatic latent image developing toner as claimed in claim 1, wherein the release agent is contained in an amount of about 0.5 mass % to about 15 mass % with respect to the toner.

12. The electrostatic latent image developing toner as claimed in claim 1, which has a volume-average particle diameter in a range from about 4 μm to about 9 μm.

13. The electrostatic latent image developing toner as claimed in claim 1, which has an average roundness in a range from about 0.95 to about 0.985.

14. An electrostatic latent image developer, comprising the electrostatic latent image developing toner as claimed in claim 1 and the carrier comprising a resin coating.

15. The electrostatic latent image developer as claimed in claim 14, wherein the resin coating comprises carbon black.

* * * * *